US012559280B2

(12) United States Patent
Shtraks et al.

(10) Patent No.: US 12,559,280 B2
(45) Date of Patent: Feb. 24, 2026

(54) MEAL PACKAGING SYSTEM

(71) Applicant: Front Row Labs LLC, Newtown, PA (US)

(72) Inventors: Valery Shtraks, Newtown, PA (US); Michael J. Korsky, Newtown, PA (US)

(73) Assignee: Front Row Labs LLC, Newtown, PA (US)

( * ) Notice: Subject to any disclaimer, the term of this patent is extended or adjusted under 35 U.S.C. 154(b) by 0 days.

(21) Appl. No.: 18/330,908

(22) Filed: Jun. 7, 2023

(65) Prior Publication Data

US 2023/0391488 A1 Dec. 7, 2023

Related U.S. Application Data

(60) Provisional application No. 63/349,941, filed on Jun. 7, 2022.

(51) Int. Cl.
*B65B 57/00* (2006.01)
*B65B 57/12* (2006.01)
(Continued)

(52) U.S. Cl.
CPC ..... *B65B 57/00* (2013.01); *B65B 57/12* (2013.01); *B65B 57/14* (2013.01);
(Continued)

(58) Field of Classification Search
CPC ..... B65B 25/001; B65B 57/00; B65B 57/10; B65B 57/12; B65B 57/14; B65B 67/02;
(Continued)

(56) References Cited

U.S. PATENT DOCUMENTS 3,115,290 A * 12/1963 Byassee ..... B65D 5/48014 229/120.24
5,335,846 A * 8/1994 Smith et al. ..... B65D 77/02 229/120.32

(Continued)

FOREIGN PATENT DOCUMENTS

KR 100856067 B1 * 9/2008 ..... B65D 5/46024

OTHER PUBLICATIONS

International Search Report and Written Opinion for International Application No. PCT/US23/68077, filed Jun. 7, 2023, mailed Nov. 6, 2023.

*Primary Examiner* — Stephen F. Gerrity
(74) *Attorney, Agent, or Firm* — Fox Rothschild LLP

(57) ABSTRACT

A meal packaging system is disclosed. The meal packaging system includes a divided packaging that includes an outer shell defining an interior, and at least one divider disposed within the outer shell. The divider divides the interior into multiple container compartments having compartment dimensions. The meal packaging system also includes multiple food containers configured and dimensioned to fit within the container compartments. The meal packaging system further includes a computing device having a processor configured to execute instructions to cause the computer device to receive food selection data, generate a food selection scheme based on the food selection data, and output the food selection scheme. The food selection scheme includes instructions to place first and second of the food containers within first and second of the compartments.

19 Claims, 20 Drawing Sheets

(51) Int. Cl.
*B65B 57/14* (2006.01)
*B65D 5/48* (2006.01)
*B65D 71/24* (2006.01)

(52) U.S. Cl.
CPC ..... *B65D 5/48014* (2013.01); *B65D 71/24* (2013.01); *B65B 2210/04* (2013.01); *B65B 2220/14* (2013.01); *B65B 2220/16* (2013.01); *B65B 2230/02* (2013.01); *B65D 2203/06* (2013.01); *B65D 2203/10* (2013.01)

(58) Field of Classification Search
CPC ..... B65B 2210/04; B65B 2220/14; B65B 2220/16; B65B 2230/02; B65D 5/48014; B65D 71/24; B65D 77/0433; B65D 2577/045; B65D 2577/046; A47J 47/14
USPC ..... 53/493, 169, 171, 173; 229/120.32; 705/332
See application file for complete search history.

(56) References Cited

U.S. PATENT DOCUMENTS 6,422,454 B1 * 7/2002 Barr et al. ..... B65D 5/5425 229/162.1
6,561,417 B1 * 5/2003 Gadd ..... G06Q 10/087 705/28
9,902,511 B2 * 2/2018 Minvielle ..... A23P 10/00
10,496,798 B2 * 12/2019 Wilkinson ..... G16H 20/60
11,144,982 B1 * 10/2021 Raak et al. ..... G06Q 30/0223
11,514,538 B2 * 11/2022 Chen ..... G07G 1/0036
11,613,402 B2 * 3/2023 Nikolic ..... B65D 85/36 229/117.25
2005/0281921 A1 * 12/2005 Langston et al. ..... A23B 2/30 426/120
2006/0208049 A1 * 9/2006 Duerson et al. ... B65D 5/48014 229/120.21
2008/0017655 A1 1/2008 Martel et al.
2009/0181131 A1 * 7/2009 Forbes-Roberts ..... A23L 35/00 426/106
2010/0076901 A1 * 3/2010 Bosher ..... B65D 81/264 705/332
2010/0236960 A1 * 9/2010 Niven et al. ..... A61J 7/0069 206/459.1
2010/0280918 A1 * 11/2010 Balent ..... G06Q 30/0633 705/26.81
2011/0268848 A1 * 11/2011 An et al. ..... B65D 85/72 426/106
2014/0252076 A1 * 9/2014 Pollock et al. .... B65D 5/48048 229/122
2016/0054049 A1 2/2016 Harvie
2016/0264340 A1 * 9/2016 Tu et al. ..... B65D 5/46144
2017/0069225 A1 3/2017 Ortiz et al.
2017/0115045 A1 4/2017 Aiken
2019/0359407 A1 * 11/2019 Kale et al. ..... A23B 2/8055
2020/0399019 A1 12/2020 Cotton
2021/0150474 A1 * 5/2021 Park et al. ..... G06Q 10/0833
2022/0119184 A1 4/2022 Knezovich et al.

* cited by examiner

MEAL PACKAGING SYSTEM

CROSS-REFERENCE AND CLAIM OF PRIORITY

This patent document claims priority to U.S. Provisional Patent Application No. 63/349,941, filed Jun. 7, 2022, the entirety of which is incorporated herein by reference.

BACKGROUND

This disclosure relates to the field of pre-packaged meals, such as those provided by meal delivery services. Many existing meal services deliver meals in inconvenient or large packaging. Additionally, when receiving a meal delivery that includes multiple meals, the current packaging structures and corresponding systems make is difficult for users to inventory all of the food items they have received or to customize meals after receiving the order.

This patent document describes systems, methods, and devices that address at least some of the issues described above and/or other issues.

SUMMARY

At least some of the problems associated with the existing solutions will be shown solved by the subject matter of the independent claims that are included in this document. Additional advantageous aspects are discussed in the dependent claims.

In various embodiments, a meal packaging system is disclosed. The meal packaging system includes a divided packaging that includes an outer shell defining an interior, and at least one divider disposed within the outer shell. The divider divides the interior into multiple container compartments having compartment dimensions. The meal packaging system also includes multiple food containers configured and dimensioned to fit within the container compartments. The meal packaging system further includes a computing device having a processor configured to execute instructions to cause the computer device to receive food selection data, generate a food selection scheme based on the food selection data, and output the food selection scheme. The food selection scheme includes instructions to place first and second of the food containers within first and second of the compartments.

Implementations of the disclosure may include one or more of the following optional features. The meal packaging system may further include a user electronic device configured to receive food selections from a user and transmit the food selection data to the computing device. In some examples, outputting the food selection scheme includes displaying an indication of the first and second food containers. Outputting the food selection scheme may include displaying an indication of options or meal combinations based on the food selection data. The container sleeve may further include a second shelf that separates the carton interior into three vertically stacked compartments. In some examples, a first end of the container sleeve includes an opening, the first and second food containers include an identifier, and the identifier is readable through the opening. The opening may be a translucent portion of the first end. The opening may be a window through a portion of the first end. In some examples, the opening defines an access port for adding or removing food containers from the container sleeve. In some examples, the container sleeve further includes a door, the door covers the opening when the door is in a closed position, and the compartments are accessible when the door is in an open position. In some examples, the identifier is not readable when the door is in a closed position. In some examples, the identifier is readable when the door is in a closed position. The identifier may be machine-readable and may include one or more of the following: a bar code, a QR code, an electronic tag, or an RFID tag. At least one of the multiple food containers may be dimensioned to have an interference fit with the divided packaging. The divided packaging may include a sleeve having four sides defining an interior. The compartments may be vertically stacked. In some examples, the food selection scheme includes an indication of a specific number of food containers based on a number of compartments of the divided packaging. The identifier may include an expiration date. The identifier may include a food type. In some examples, the container sleeve further includes a handle disposed on a first of the sides and the container sleeve further includes an opening on a second side that is perpendicular to the first side. The handle may be configured to be grasped from the top of the container sleeve. The handle may include one or more openings. The openings may be cutouts in the first side. In some examples, the food containers are sized relative to the container sleeve such that the container sleeve applies pressure to two opposite sides of the container. In some examples, a first end of the vertical sleeve carton is open and a second end of the vertical sleeve carton is closed. Outputting the food selection scheme may include sending instructions to a packaging device. The packaging device may include a container filler configured to fill the first and second food containers with corresponding food components. The packaging device may include multiple pre-filled food containers and may be configured to load the pre-filled food containers into the container sleeve. The first container may contain a first food component and the second food container may contain a second food component. The first food component may be different from the second food component. The first and second food components may together comprise a meal. The meal may be based on a volume of food. The meal may be based on a mass of food. The meal may be based on a food type of the first food component and second food component. The meal may be based on a cumulative nutritional value of the first and second food components.

In some alternate embodiments, a vertical meal container is disclosed. The vertical meal container includes a container sleeve defined by four sides, a first end, and a second end. The vertical meal container further includes a first shelf disposed on the interior of the sleeve and attached to a first side and a second side of the four sides. The vertical meal container further includes a second shelf disposed on the interior of the carton parallel to the first shelf and attached to the first and second sides. The vertical meal container further includes multiple food containers including four upright walls, a bottom, and an openable top. A first food container is disposed between the first shelf and a third side of the sleeve. A second food container is disposed between the first and second shelves. And a third food container is disposed between the second shelf and a fourth side of the sleeve.

Implementations of the disclosure may include one or more of the following optional features. The meal container may further include a handle located on the fourth side of the sleeve. The handle may include one or more openings in the fourth side. The first shelf and second shelf may extend longitudinally from the first end to the second end.

In some alternate embodiments, a method for providing packaged meals is disclosed. The method includes receiving, by a processor, meal selection data. The method further includes determining, by the processor and based on the meal selection data, a meal including a first food component, a second food component, and a third food component. The method further includes filling a first container with an amount of the first component, filling a second container with an amount of the second component, and filling a third container with an amount of the third component. The method further includes obtaining a container sleeve having an outer wrap, an open end, and three compartments defined by a first shelf and a second shelf. The method further includes loading the first, second, and third containers into the compartments of the container sleeve.

Implementations of the disclosure may include one or more of the following optional features. In some examples, the meal selection data includes an indication of total meal calories, and the amounts of the first, second, and third components are based on the total meal calories. The meal selection data may include an indication of total meal mass, and the amounts of the first, second, and third components may be based on the total meal weight. The meal selection data may include an indication of a cumulative nutritional value, and the amounts of the first, second, and third components may be based on the cumulative nutritional value. The meal selection data may include an indication of total meal volume, and the amounts of the first, second, and third components may be based on the cumulative nutritional value. In some examples, the method further includes determining a meal size based on the meal selection data, wherein obtaining the container sleeve is based on the meal size, and wherein the first, second, and third containers have a size corresponding to the container sleeve size. The method may further include sealing the filled first, second, and third containers. In some examples, the first, second, and third containers are loaded into the compartments of the container sleeve in an orientation in which the open end exposes at least a portion of the first, second, and third containers, and the exposed portions of the first, second, and third containers display an identifier. The method may further include scanning the identifier and updating, based on the scanning, an inventory of food components that is associated with an individual.

DETAILED DESCRIPTION

Terminology that is relevant to this disclosure includes:

An "electronic device" or a "computing device" refers to a device that includes a processor and memory. Each device may have its own processor and/or memory, or the processor and/or memory may be shared with other devices as in a virtual machine or container arrangement. The memory will contain or receive programming instructions that, when executed by the processor, cause the electronic device to perform one or more operations according to the programming instructions. Examples of electronic devices include personal computers, servers, mainframes, virtual machines, containers, gaming systems, televisions, and mobile electronic devices such as smartphones, personal digital assistants, cameras, tablet computers, laptop computers, media players and the like. In a client-server arrangement, the client device and the server are electronic devices, in which the server implements instructions and/or data to provide a service that the client device accesses via one or more communications links in one or more communications networks. In a virtual machine arrangement, a server may be an electronic device, and each virtual machine or container may also be considered to be an electronic device. In the discussion below, a client device, server device, virtual machine or container may be referred to simply as a "device" for brevity.

In this document, the singular forms "a," "an," and "the" include plural references unless the context clearly dictates otherwise. In this document, the term "comprising" means "including, but not limited to." Unless defined otherwise, all technical and scientific terms used in this document have the same meanings as commonly understood by one of ordinary skill in the art.

Figure 1:
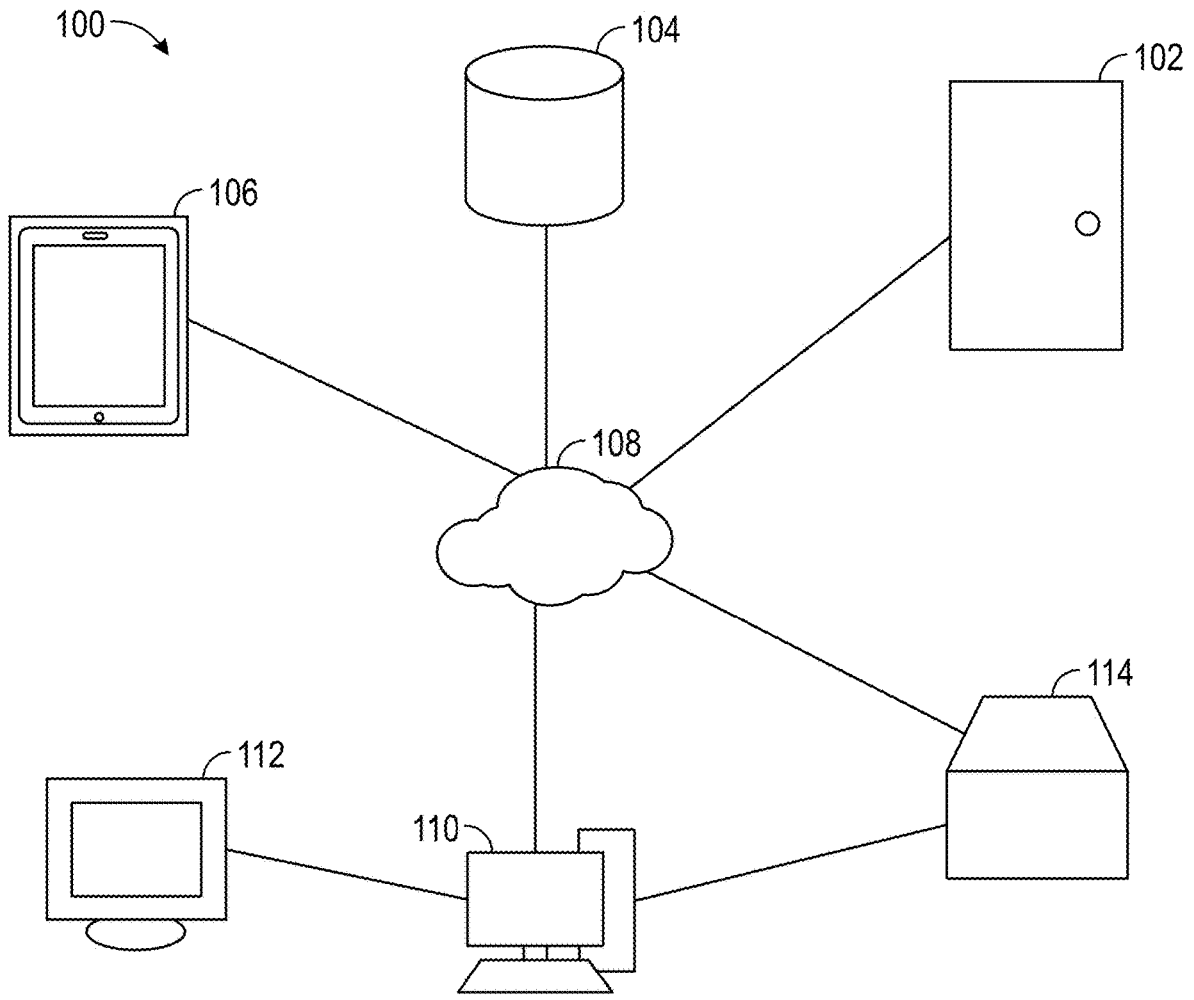
FIG. 1 is a diagram depicting an example meal packaging system.

FIG. 1 illustrates various elements of a meal packaging system 100. The system includes a meal configuration server 102 that is includes or is communicatively connected to a data store 104 of meal and user information, such as food components, meal combinations, user profiles and preferences, packaging configurations, etc. The server 102 communicates with any number of client electronic user devices 106 via one or more communications networks 108. The meal configuration server 102 provides a website and/or data for one or more client-installed meal configuration applications that the client electronic devices 106 can access via one or more locally installed applications, such as a web browser, dedicated mobile application, or other type of software application. A user of a client electronic device 106 may view, select, customize, and order meals using interface provided by server 102 or via the application installed on the user's client electronic device 106. In various embodiments, the meal configuration server 102 also may communicate with a packaging computing device 110 via the communications network(s) 108. In other embodiments, the meal configuration server 102 may itself also include programming and perform functions of the packaging computing device 110 that will be described below.

Packaging computing device 110 is connected to at least one of a display 112 or a packaging device 114. Packaging computing device 110 and packaging device 114 can be connected directly (e.g., a wired or other device to device direct communication) or can communicate through network 108. Optionally, packaging computing device 110 can be onsite at a warehouse or other facility, and may be remote from meal configuration server 102. In some embodiments, packaging computing device may be remote from display 112 or packaging device 114, which instead may be onsite at a warehouse or other facility. Packaging device 114 can be a robotic picker, robotic packaging machine, or similar robotic machine that can package meals. Functions of packaging device 114 will be described in more detail below.

Figure 12:
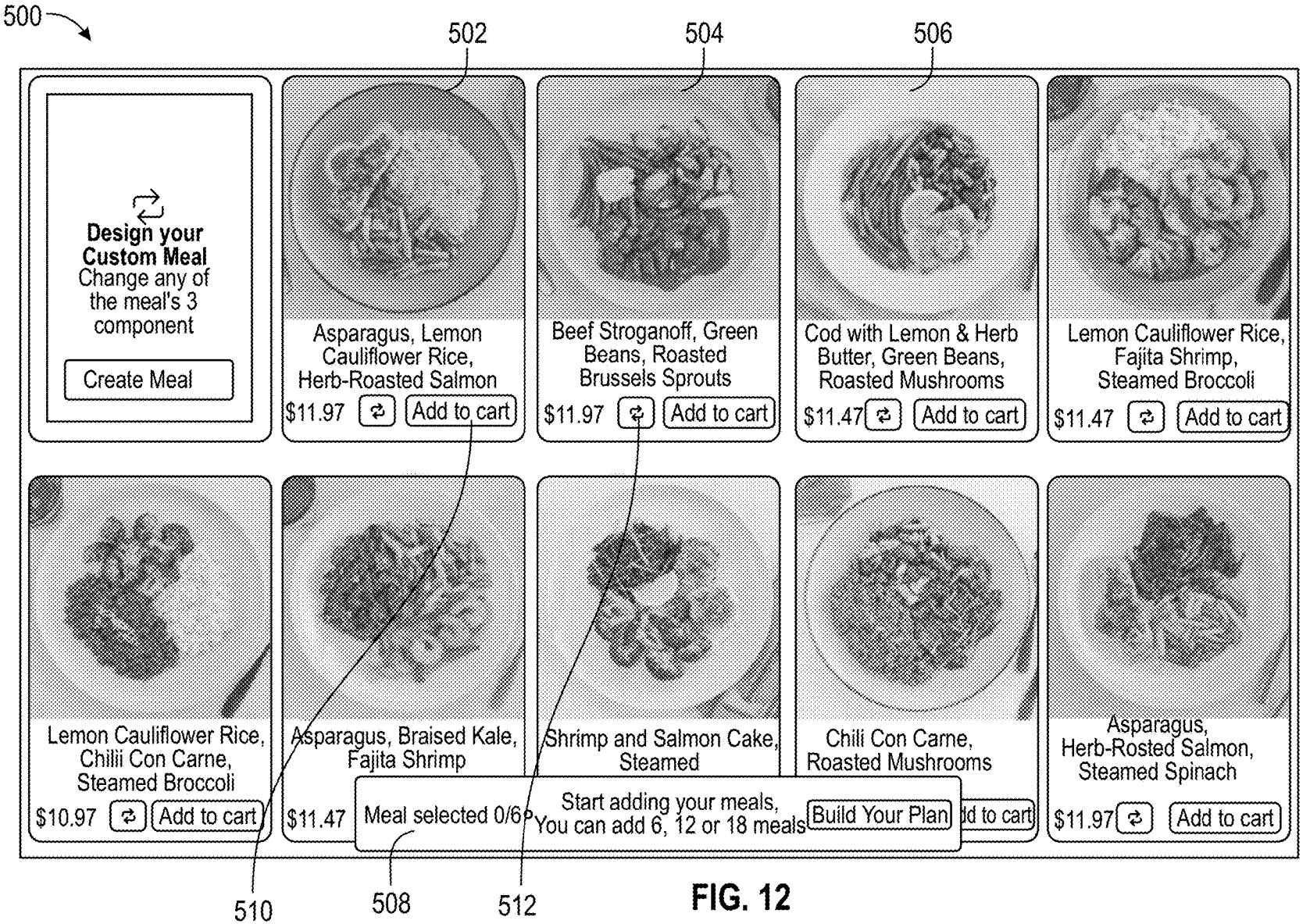
FIG. 12 illustrates an example user interface of a meal packaging system.

The meal configuration server 102 executes programming instructions of a meal configuration engine that causes the locally installed application of the client device 106 to output a web page or other user interface by which a user may view, select, and/or order products from the meal distributor who is associated with the server 102. Alternatively, the meal configuration server 102 may provide instructions and/or data to the locally installed application to enable the client device 106 to operate as the meal configuration engine and output the user interface. The webpage or user interface may include a script, authentication mechanism, or other technical feature that calls or points to an address of the meal configuration server 102 so that the meal configuration server 102 serves the meal configuration application, data, and/or instructions to the client device 106 via a window or pop-up within the webpage or product configuration application. An example of this is illustrated in FIG. 12, in which the user interface of a meal configuration engine 500 is a web page, as displayed by a browser application, with a drop-down or otherwise functional menu via which the user may access functions of the meal configuration engine.

The meal configuration engine 500 may initially output a number of questions or user-selectable options for which the user can respond. By way of example in FIG. 12, the system provides a list of pre-configured meals that a user can choose from. As described below, the user may select one or more of these meals, which the user interface may enable the user to customize by changing one or more of the food components (i.e., protein, vegetable, and/or starch) within the meal. As another example, shown in FIG. 13, the meal configuration engine 500 can provide user-selectable options for individual meal components to create a meal. Thus, the system may enable the user to select meals or components without necessarily answering a number of questions or filtering through a variety of selectable options. Instead, the system may present the user with meals or food components and provide an interface via which the user is given the option of making individual selections.

The meal configuration server may also provide a set of questions. As an example, the questions may relate to a user's food preferences, allergies, sensitives, specific diet plans the user adheres to, medical conditions, or other dietary restrictions or requests. In some embodiments, the meal configuration server may provide a set of questions in a tree-based rule set (or another structured rule set) to provide the shortest path to a specific meal selection. The questions may result in a selection of a specific meal recommendation, or a subset of meals or meal components.

Example: a first scenario may require ten user interactions to get to the optimal recommendation, while a second scenario (with different user responses to the initial questions) may allow the user to get to the meal selection in three steps. As another example, if a user's profile includes a specific medical condition or taste preference (such as a gluten allergy or an aversion to mushrooms), then the meal configuration engine may exclude any meal components that conflict with that condition (i.e., by presenting that user options that only include meal components that are gluten-free or mushroom-free and not offering that user any meal components that contain gluten or mushrooms).

The meal configuration server can, based on the user's answers to the questions, generate a score for meal components or pre-packaged meals. The score can provide an indication of the meal's compatibility with the user. A score may be a numerical score or other quantitative score, a relative level, or a pre-defined scale or rating indicating a meal or food component's suitability for a particular person. For example, a score may be a number within a 1-10 scale, where the higher the number, the more suitable the meal. As another example, a meal may be assigned one of three different levels or ratings such as "not suitable," "moderately suitable," or "ideal." The score can be based on one or more of the user's answers. For example, if a user indicates that she is allergic to dairy products, the server can give a score of "1" or "not suitable" to all meals or food components containing milk, cheese, or other dairy products. As another example, if a user's answers indicate that they require a high protein diet, the meals with greater than 30 grams of protein can receive high scores (e.g., over an 8 or a "moderately suitable" or "ideal"). The system may determine which meals or food components exceed a threshold score value and then present those to the user in the interface. Additionally, or alternatively, the system may identify the highest scored meals or components and generate custom meals or a custom meal plan based on the scores.

Figure 19:
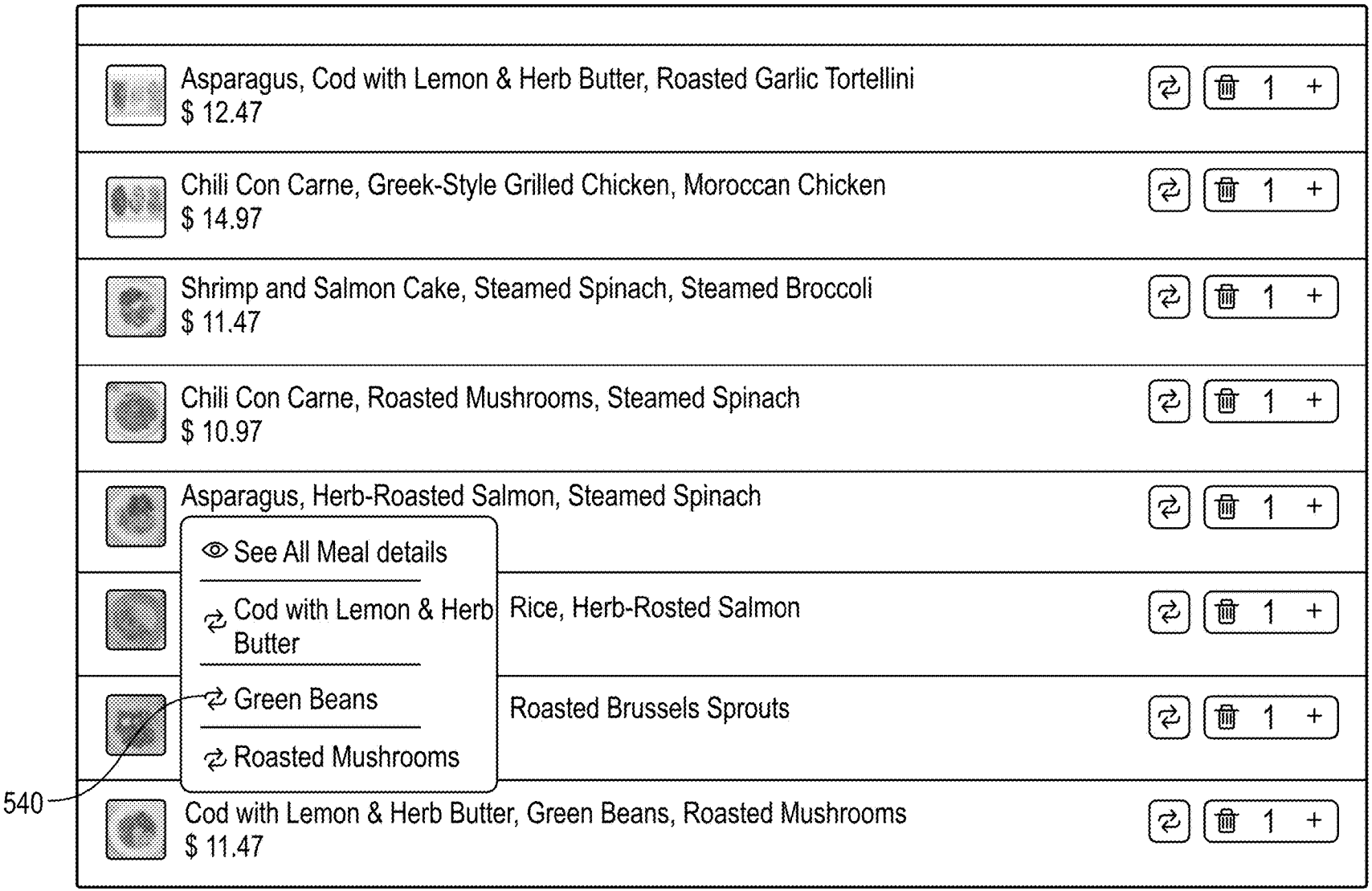
FIG. 19 illustrates an example user interface of a meal packaging system.
Figure 20:
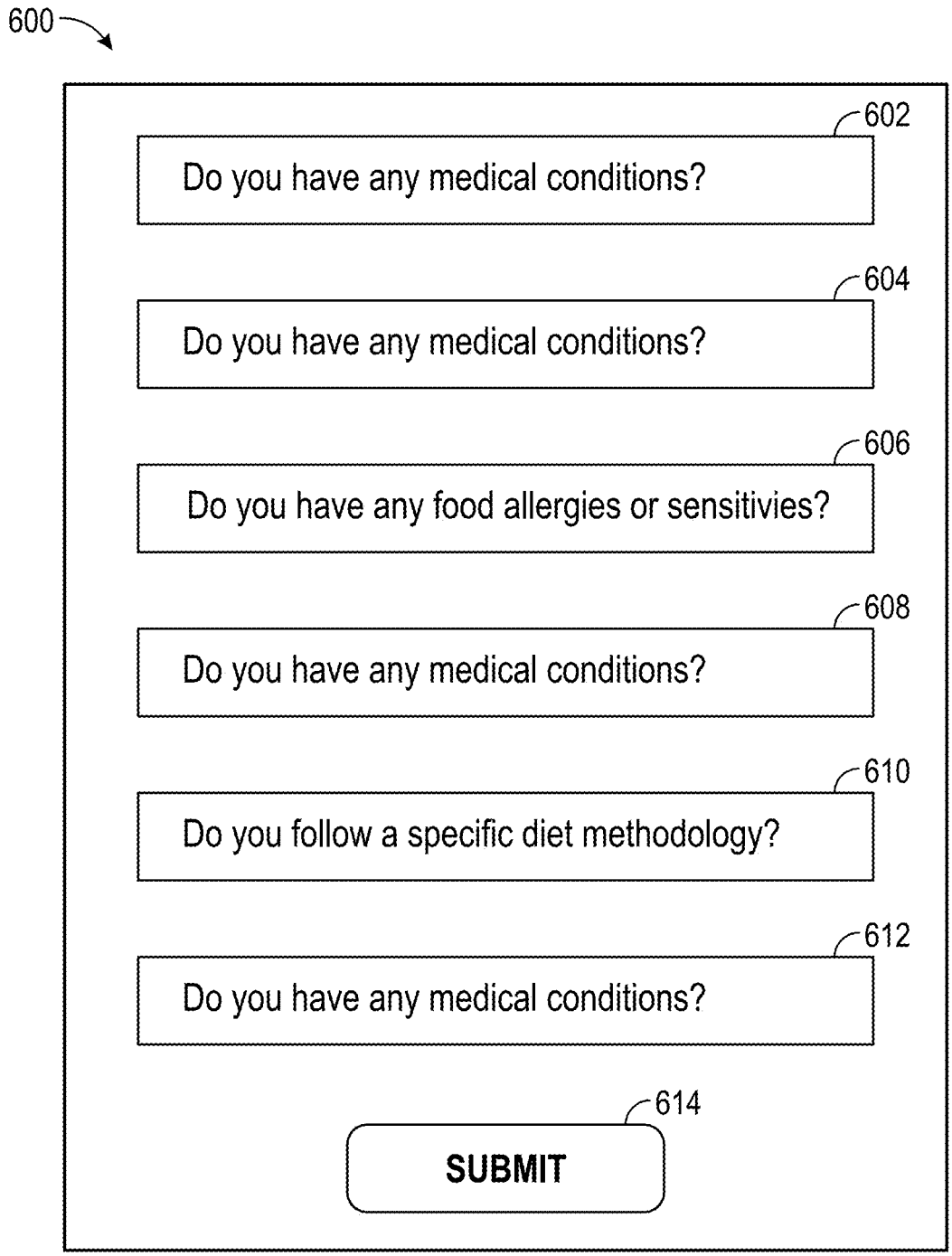
FIG. 20 illustrates an example user interface of a meal packaging system.

The selections of meals or meal components by the system can result in meal selection data (in the form of the selections) being sent from the user client device 106 to the meal configuration server 102. The meal selection data may include pre-configured meal selections, individual component selections, diet selections, dietary restrictions information, medical diagnosis information, food sensitivities, calorie goals, food volume restrictions, macronutrient requirements, micronutrient requirements, and/or other information indicating a user's food preferences. The food selection data may come in the form of user selected options for meals or food components (e.g., as shown in FIGS. 12-19) or a survey (e.g., as shown by FIG. 20). Upon receiving the meal selection data, the configuration server 102 can generate a food selection scheme based on the meal selection data. The food selection scheme is data indicating the meals to be packaged and sent to the user. For example, the food selection scheme can indicate the specific pre-configured meals that the user selected, as well as a quantity for each meal. Similarly, the food selection scheme can indicate the specific food components a user has selected. Configuration server 102 may analyze the components and place them into meals (e.g., for packaging together in a container sleeve). The food selection scheme can further include instructions for a packaging system to place one or more containers of food or a plurality of containers into a container sleeve. For example, the food selection scheme can also include instructions to place first and second food containers within first and second compartments of a container sleeve. The food selection scheme can also include packaging information such a size of the containers in which to package the food, as well as a size or configuration of a container sleeve in which to place the containers. For example, the food selection scheme can include an indication of a specific number of food containers based on a number of compartments of the divided packaging. In other words, the number or containers can be selected based on the number compartments in a container sleeve, or vice-versa.

As used herein, a food component (or meal component) is a portion of food that makes up a larger meal. For example, a food component could be a meat, such as chicken. As another example, a food component could be a vegetable, such as green beans. As a third example, a food component could be a starch, such as a potato or rice. A meal is a combination of two or more food components. Additionally, or alternatively, a meal can be defined by a certain volume of food, a certain amount of mass of food, a certain combination of food types (e.g., a protein, a starch, and a vegetable), or a certain cumulative nutritional value. A cumulative nutritional value can be based on a desired amount of macronutrients (fat/carbs/protein) or micronutrients (vitamins, minerals, etc.). As an example, a meal could be created to have a total of 50 grams of protein or at least 100 mg of magnesium. As another meal example, a meal could be the equivalent of three containers 202 of food. As another example, a meal could be 60 cubic inches of volume of food.

Upon determining the food selection scheme, packaging computing device 110 can output the food selection scheme to a display 112 or packaging device 114. Outputting the food selection scheme to the display 112 can include sending instructions to display an indication of specific food containers to be placed in a container sleeve. For example, outputting the food selection scheme can include displaying an indication of the first and second food containers that are to be loaded into a container sleeve. This display, for example, can be placed in a packaging department and a human packer could view the display and place the corresponding containers into a container sleeve for shipping to the consumer.

In another embodiment, the food section scheme can be output to a packaging device 114. Packaging device 114 is an automated machine that picks food containers and loads food containers into a container sleeve. In some embodiments, packaging device can include a refrigerated portion in which pre-filled food containers are stored. In other embodiments, packaging device 114 is loaded with various food components and stock of containers. Packaging device 114 can include a container filler configured to fill the containers with the desired food component (based on the food selection scheme), seal the containers, and place the containers into a container sleeve.

The food components loaded into containers and placed into a container sleeve can be different from each other or the same. Together, the combination of one or more components can form a meal, as described above. In other embodiments, an entire meal may be packaged into a single container. Thus, multiple containers each having a meal within them could be loaded into a container sleeve.

Figure 2:
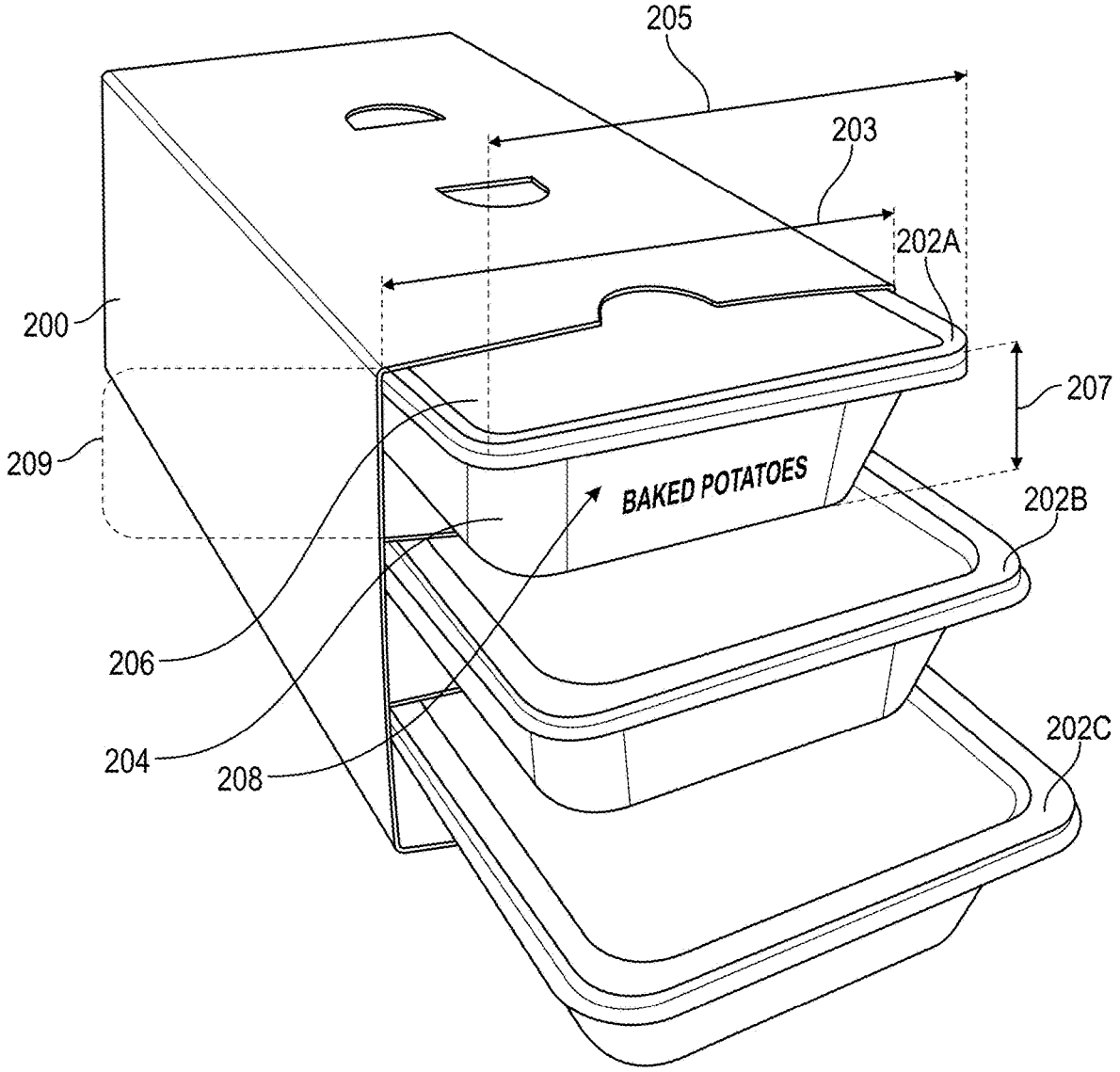
FIG. 2 is a perspective view of an embodiment of a container sleeve with food containers packaged therein as used in the system of FIG. 1.

Thus, system 100 can be used to fill and pack food containers for distribution to customers. Accordingly, the system can further include a plurality of food containers and one or more packaging elements, such as divided packaging elements. FIG. 2 illustrates a perspective view of an embodiment of a divided packaging element, which is provided as a container sleeve 200 configured to pack food containers 202A-C, for example such that they can be slid in and out of the sleeve. In this embodiment, the container sleeve 200 is arranged to receive the food containers 202A-C in a vertical stack within it. Food containers 202A-C have a bottom portion 204 and a top 206. Food containers 202A-C also include an identifier 208, which is placed on an outside surface of the bottom portion 204, top 206, or both. Identifier 208 can be a written indication of information related to the contents of the food container 202. For example, identifier 208 can be a name or type of the food within the food container, nutritional information, an expiration date associated with the food, and/or other desired information. As an example, a type of food may include a category of such as meat or protein, starch, or vegetable. The food type may also include a name of the food such as salmon, chicken, white rice, or corn. In some embodiments, the identifier is machine-readable. A machine-readable identifier can include a linear bar code, a two-dimensional code such as a QR code, a data matrix code, or other machine-readable code. A machine-readable identifier can also include an electronic tag, such as an RFID tag, a Bluetooth or Bluetooth Low Energy (BLE) tag.

Containers 202A-C of this embodiment are configured and dimensioned to form a close fit within container sleeve 200, so that the container sleeve 200 retains the containers 202A-C within container sleeve 200 against falling out. In other words, the containers 202A-C can be sized relative to the sleeve 200 such that the sleeve 200 applies pressure to two opposite sides of the containers 202A-C (e.g., either the top and bottom, left and right sides, or both). As one example, containers 202A-C have a width 205 that can be slightly larger than the width 203 of the container sleeve. Additionally, or alternatively, the height 207 of the containers 202A-C can be slightly larger than the height 209 of a compartment of the sleeve 200. Thus, the containers 202A-C can be dimensioned to have an interference fit with the divided packaging. In other embodiments, sleeve 200 or containers 202A-C can include a retention feature such as a small protrusion. For example, containers 202A-C could include a small protrusion on an outside surface positioned to contact an inner wall of sleeve 200. Additionally, or alternatively, sleeve 200 could have a protrusion on an inside surface that is positioned to contact one or more of the containers 202A-C when the containers are placed in or removed from sleeve 200. In other embodiments, the container sleeve 200 can include a retention mechanism, such as a protrusion that interacts with or blocks the food containers 202A-C from falling out.

Figure 3:
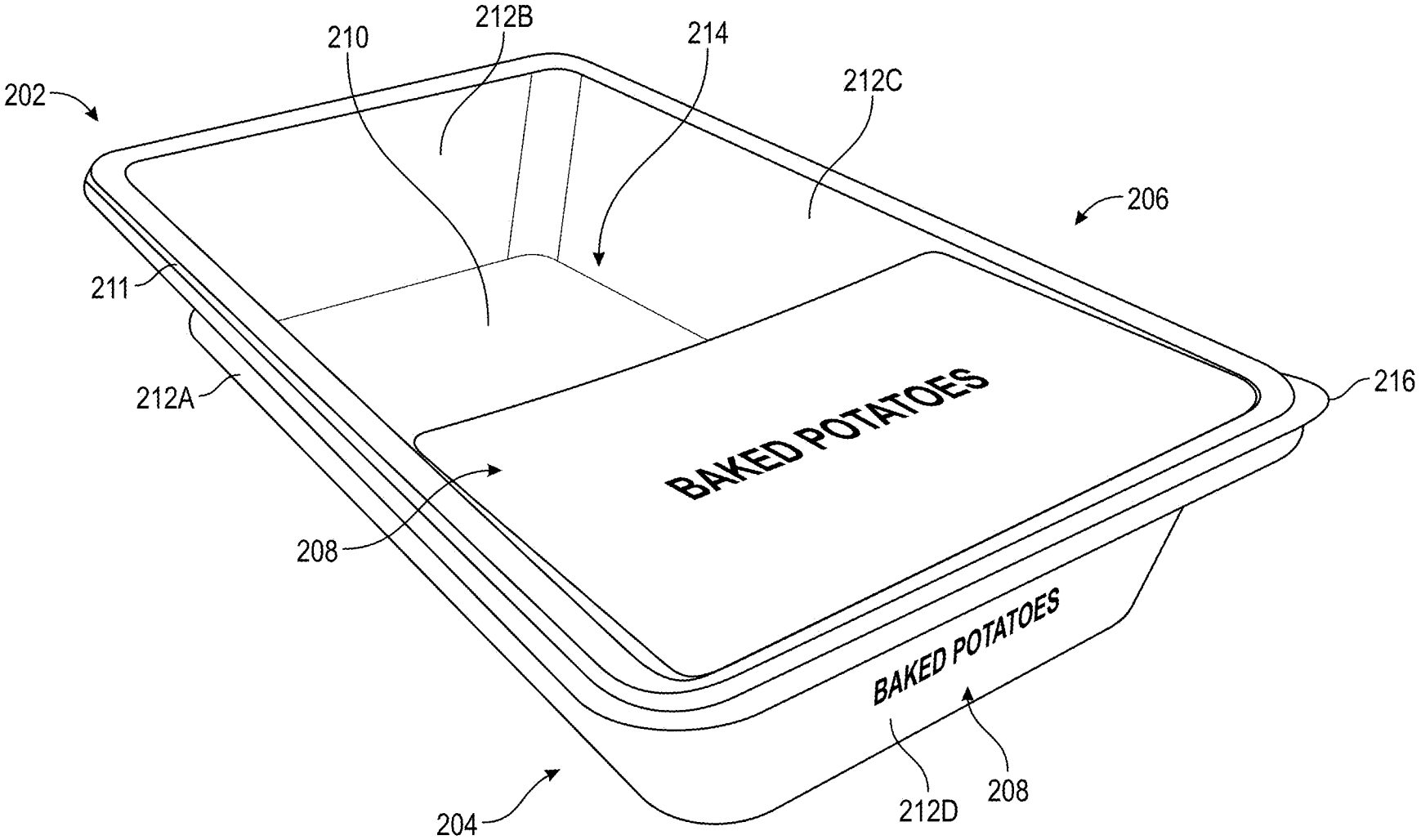
FIG. 3 is a perspective view of a food container of FIG. 2.

Referring to FIG. 3, bottom portion 204 of container 202 includes a bottom 210, and four substantially vertical walls 212A-D. The bottom 210 and walls 212A-D define a cavity 214 into which a food component can be placed. The walls 212A-D can form a lip 211 at their top that extends around the perimeter of the container 202. The container 202 can be molded as one piece from a food grade plastic material or similar material, such as but not limited to crystallized polyethylene terephthalate (CPET). The material, like CPET, can be refrigerator, freezer, and shelf stable. The top 206 is a film 216 and is openable. The film 216 can be made a peelable food grade material such as high barrier EPC-60 or similar materials. The film can be peelable when sealed to container 202. In other embodiments, the top may be a lid, removeable cover, or other element that closes and/or seals the container and is openable to access the contents of the container 202.

To seal the food component within container 202, film 216 is heat sealed to the top portions of walls 212A-D. The heat seal can optionally take place as part of a modified atmospheric processing ("MAP") process. During the MAP process, the air within the container 202 can be modified by decreasing the oxygen level to less than one percent and replacing the removed oxygen with a combination of nitrogen and carbon dioxide. The low oxygen levels present within the sealed container 202 can aid in food preservation, thus increasing the shelf life of the food component within sealed container 202. In some embodiments, the selection of material for 216 can be specific to be compatible with the MAP process. Other suitable constructions of the food containers can be used in other embodiments. Other suitable sealing processes can be used.

Food components can be pre-prepared and pre-cooked. In other embodiments, food components may be prepared (i.e., various ingredients mixed together or placed into a container) but not cooked. While container 202 is described as containing a food component that serves as a part of a larger meal, in some embodiments, a single container 202 may contain a meal.

Figure 4:
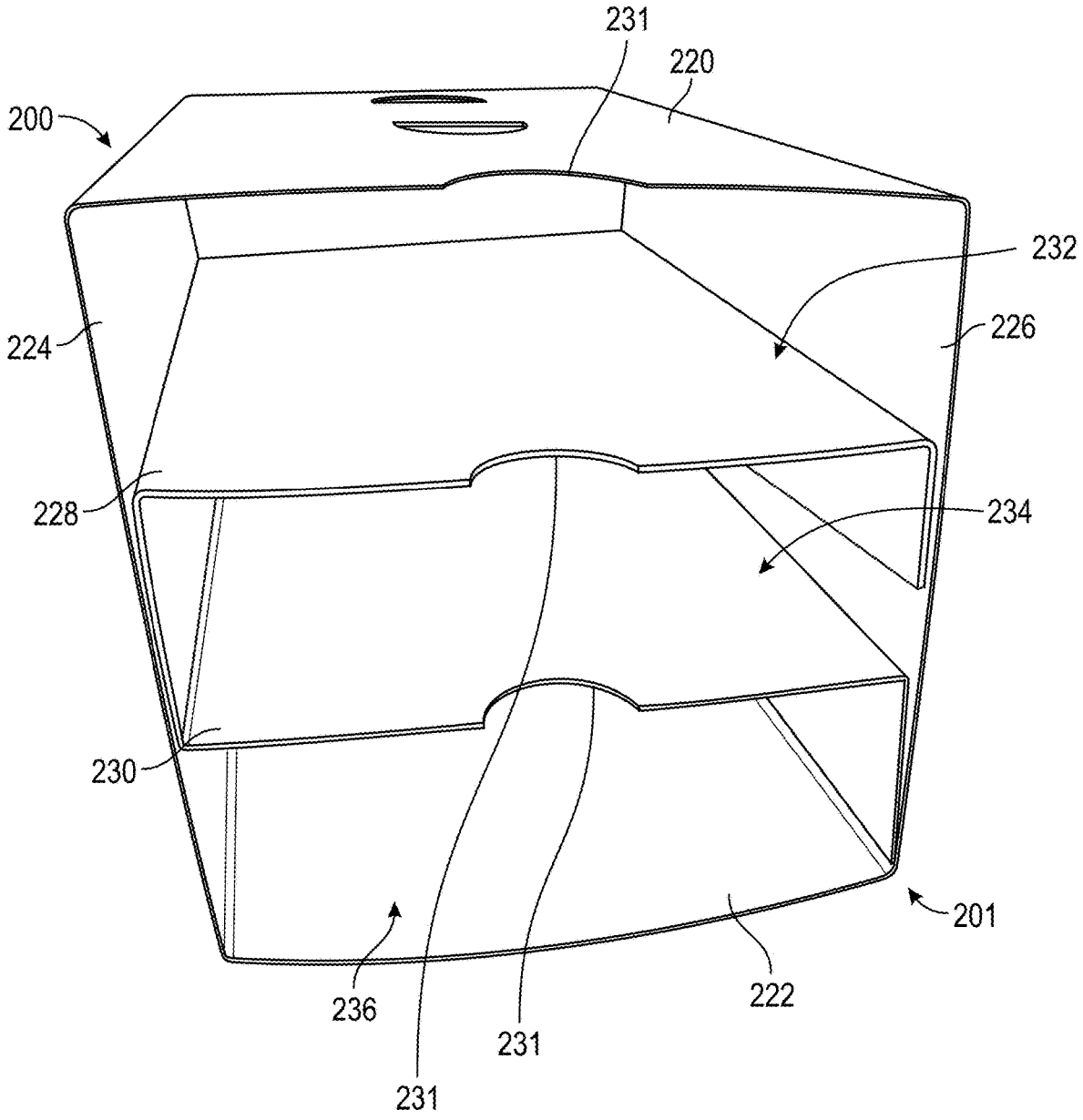
FIG. 4 is a front view of the container sleeve of FIG. 2 without food containers.

FIG. 4 illustrates a container sleeve 200. Container sleeve 200 has an outer shell forming an interior. The outer shell can be made of four sides forming a sleeve: a top 220, a bottom 222, a left side 224, and a right side 226. Between top 220 and bottom 222 are two dividers 228, 230 that are each attached to left side 224 and right side 226 and form three compartments 232, 234, 236. The dividers 228, 230 extend longitudinally along sleeve 200 from the open end 201 (also referred to herein as opening 201) to closed end 238. As described below, either end of dividers 228, 230 may be spaced from the ends of sleeve 200 by a gap 243. The end of each compartment 232, 234, 236 forms an opening. Dividers 228, 230 can form shelves that support a container 202 (e.g., as depicted in FIG. 2). The shelves are parallel to each other and to top 220 and bottom 222. Top 220 and dividers 228, 230 can include notches 231. Notches 231 can be semi-circular as depicted or take other shapes such as triangles or rectangles. Notches 231 can provide enhance a user's ability to grab a portion of food container 202 when disposed within container sleeve 200.

In other embodiments, dividers 228, 230 can be a container support. For example, the container supports can include protrusions from opposite sides, for instance the left side 224 and right side 226, that are dimensioned to support at least a portion of food containers 202, such as to support the lip 211 of containers 202. For example, a container support can be a ridge extending partially into the interior of container sleeve 200. Such a container support can be configured to not extend completely across the interior of container sleeve 200, leaving a gap between the protrusions coming from left side 224 and right side 226. This gap may permit food containers of different thicknesses to be held in container sleeve 200.

Food containers 202 can be disposed in compartment 232 between divider 228 and top 220, in compartment 234 between divider 228 and divider 230, and compartment 236 between divider 230 and bottom 222. While container sleeve 200 is depicted as having two dividers 228, 230, more or fewer dividers are possible. Further, in some embodiments, container sleeve 200 can have multiple rows of dividers forming compartments, with a vertical divider in between running from top 220 to bottom 222. Thus, as an example, container sleeve 200 could have six compartments (two vertical columns of three compartments, the vertical columns separated by the vertical divider). In other embodiments, the dividers can be arranged to arrange the compartments in a horizontal row, thereby producing a wide, flat sleeve.

The top 220 and bottom 222 of containers 202 form relatively large surface areas compared to the sides 224, 226. The orientation of containers 202 relative to their tops 220 and bottoms 222 can determine the verticality of the containers 202. Where the divided packaging arranges the food containers vertically, the larger surface areas of the food containers are stacked on each other. In other words, in a vertical orientation, the top 220 of one container will be oriented below the bottom 222 of a second container. This will form an arrangement such that the bottom 222 of one container will face the top 220 of another container. Conversely, where food containers are arranged horizontally, narrower surface areas (e.g., the sides), other than the largest, of each food container are oriented next to each other. Here, the sides of the containers can face each other and the tops and bottoms of each container will be approximately coplanar. In other embodiments, where the packaging element is a tray, the container can be oriented vertically, but placed horizontally next to each other on top of the tray (e.g., as described below and illustrated in FIGS. 9 and 10).

Figure 5:
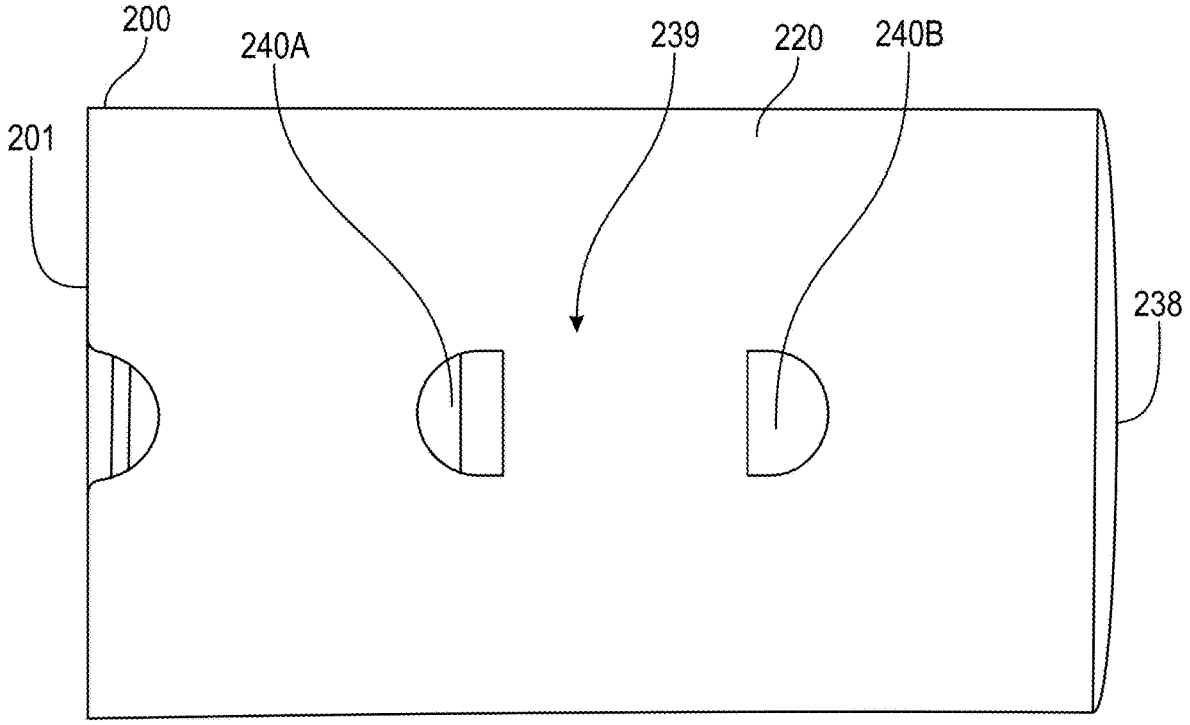
FIG. 5 is a top view of the container sleeve of FIG. 4.

FIG. 5 illustrates a top view of container sleeve 200. Container sleeve 200 includes a handle 239. The handle 239 can be disposed on top 220, making the handle configured to be grasped from the top of the container sleeve 200 and keep the container sleeve in an upright orientation. The handle can be a separate handle attached to top 220. In other embodiments, as depicted in the figures, the handle can include one or more openings 240A, 240B. The handle openings can be cutouts. Because the handle is located on top 220, it is located perpendicular to the opening 201 for compartments 232, 234, 236. The handle 239 is typically disposed on a side of the packaging, or otherwise configured to be held from a side of the packaging, located over one of the large surface-area sides of the food containers, which typically corresponds to the top side of the food containers, although in other embodiments, the handle can be placed on other sides of the packaging.

Figure 6:
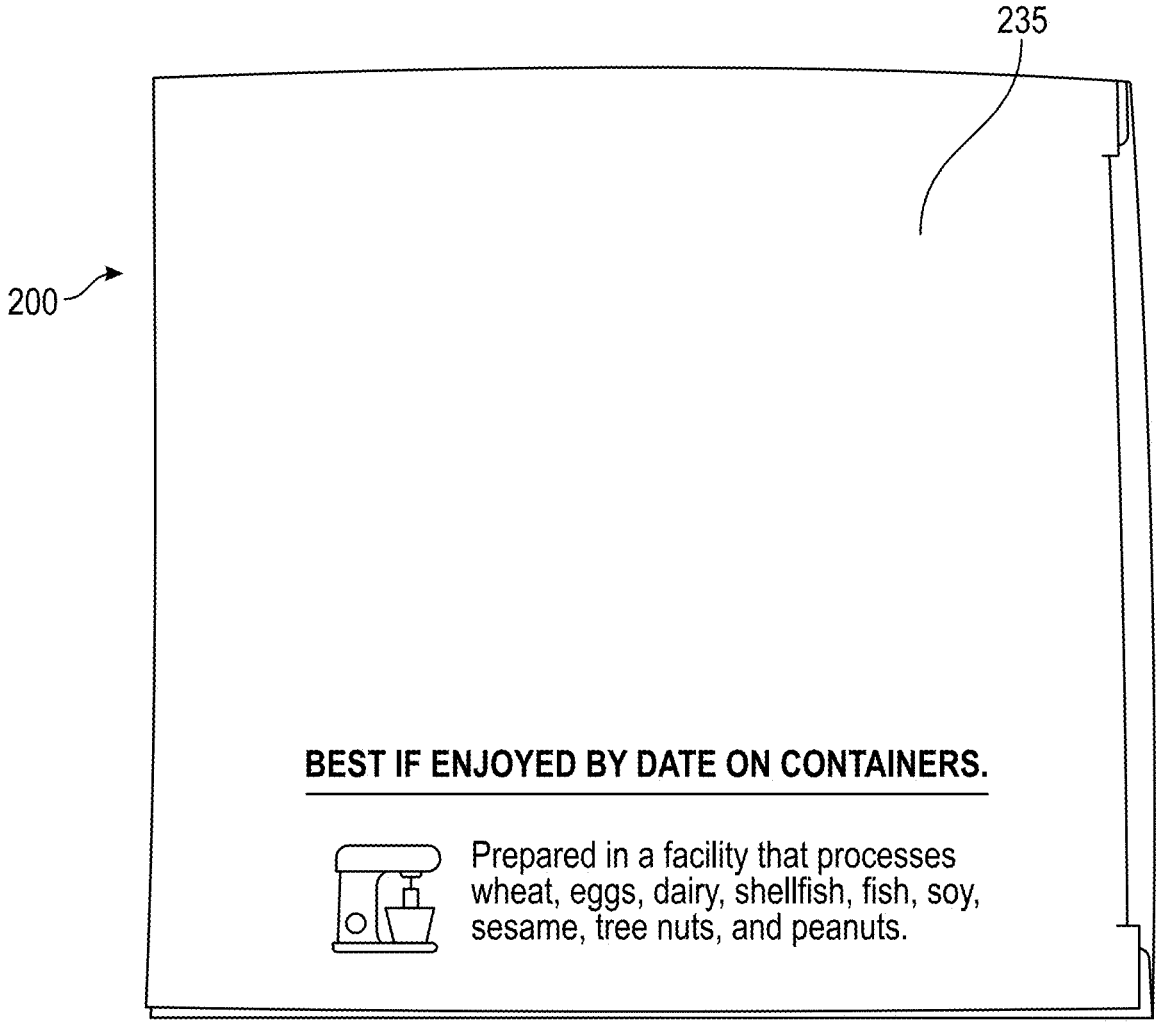
FIG. 6 is a closed back view of the container sleeve of FIG. 4.
Figure 7:
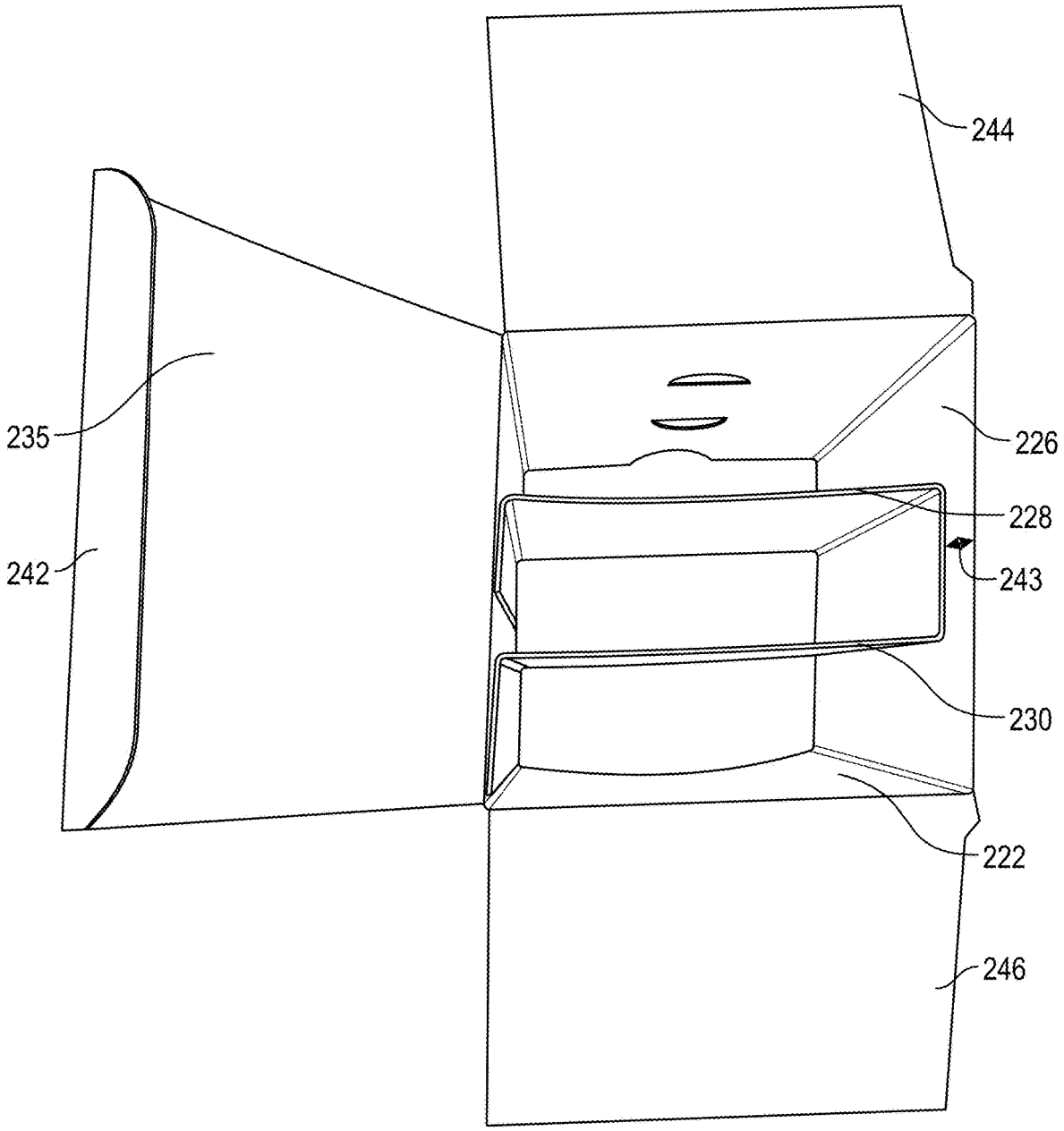
FIG. 7 is an open back view of the container sleeve of FIG. 4.

Sleeve 200 has an open end 201 and a closed end 238. The open end 201 provides an access port to compartments 232, 234, 236 for adding or removing containers 202A-C. Containers 202A-C, as shown in FIG. 2 can be positioned such that identifier 208 is visible through the opening formed by the open end. In some embodiments, a human-readable identifier is visible through an opening, while another machine sensed identifier can be positioned hidden within the packaging. The closed end of sleeve 200 is illustrated by FIGS. 6 and 7. The closed end can include a door 235. The door 235 can be in a closed positioned (FIG. 6) or an open position (FIG. 7) that provides access to the compartments 232, 234, 236. Door 235 can include a flap 242 that can be tucked inside the sleeve 200 in the closed position. A gap 243 can be present between the end of sleeve 200 and the dividers 228, 230 to provide clearance for the flap 242. The closed end of sleeve 200 can also include top flap 244 and bottom flap 246 to provide extra security to the closed end.

In other embodiments, both ends or neither ends of sleeve 200 may be closed. If both ends are closed, both ends may have a door 235 to permit access to containers placed inside the sleeve. Door 235 may include one more openings (not pictured). The openings can be a translucent portion of door 235 or a window through a portion of door 235. Identifier 208 of containers 202A-C can be visible through the open end and/or openings in door 235. For example, the translucent portions or windows of door 235 can be positioned to expose identifier 208 when door 235 is in a closed position. In embodiments without openings in the door 235, the identifier 208 is not visible when the door is in the closed position.

Figure 8:
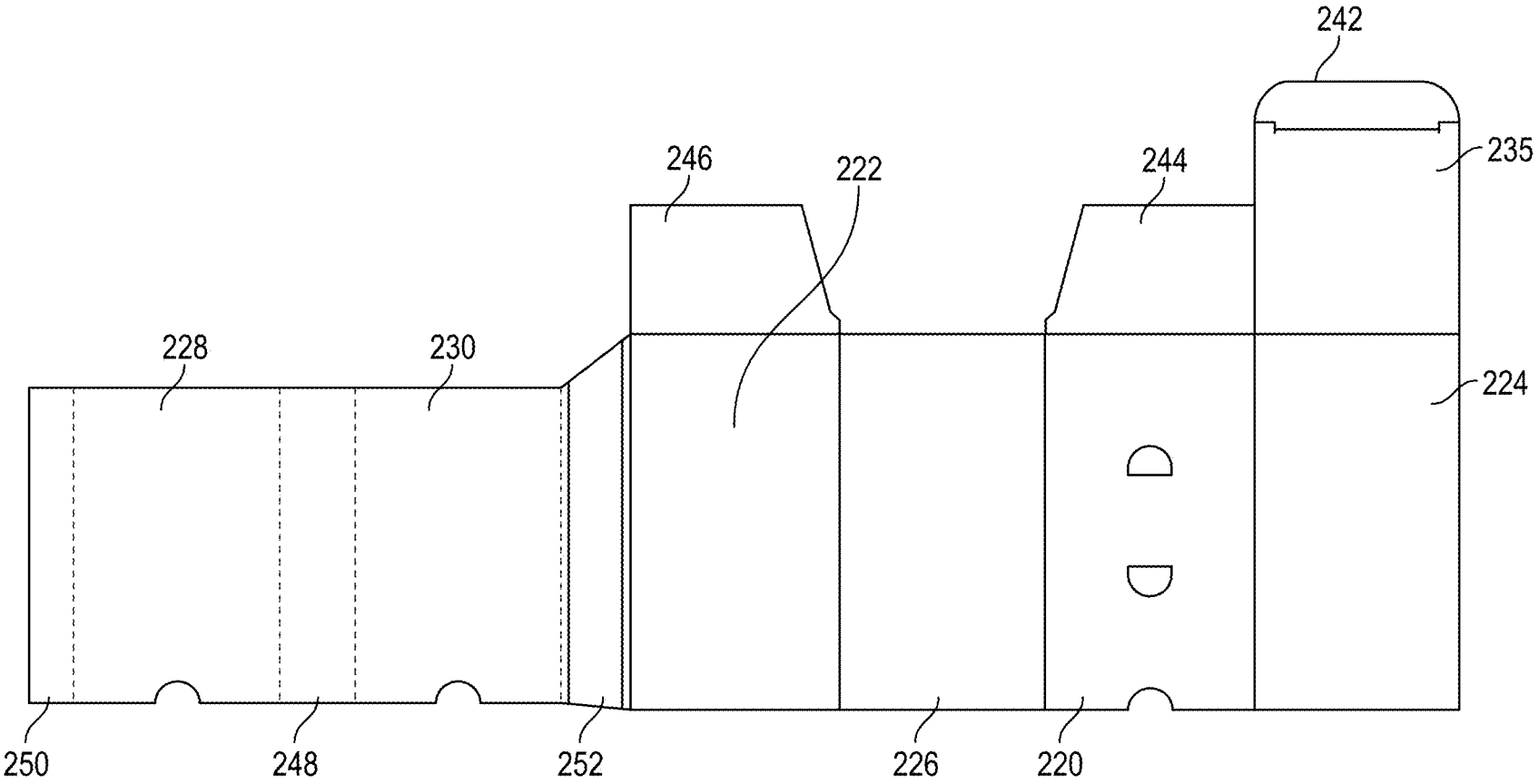
FIG. 8 is a plan view of an example unfolded blank of a container sleeve.

Sleeve 200 can be made from a cardboard, laminated cardboard, coated cardboard, paperboard, foldable plastic, or other suitable material. Sleeve 200 can be formed from a single material blank, illustrated by FIG. 8, and folded and secured to form sleeve 200. In some embodiments, an adhesive holds the assembled sleeve together, and in some embodiments, tabs or other known interlocking or otherwise folding features hold the sleeve together. In the embodiment shows, strip 248 is affixed to the left side 224, and strips 250, 252 are affixed to the ridge side 226 to form a right angle (when the food containers are loaded therein) between the sides 224, 226 and dividers 228, 230. Adhesive used to attach strips 248, 250, 252 can be a glue, tape, or other suitable adhesive material and may be specific depending on the material used to construct sleeve 200. In some embodiments, sleeve 200 may be formed by a machine that cuts or stamps the blanks, folds the blanks, and applies adhesive to strips 248, 250, 252 to form the sleeve 200.

Figure 9:
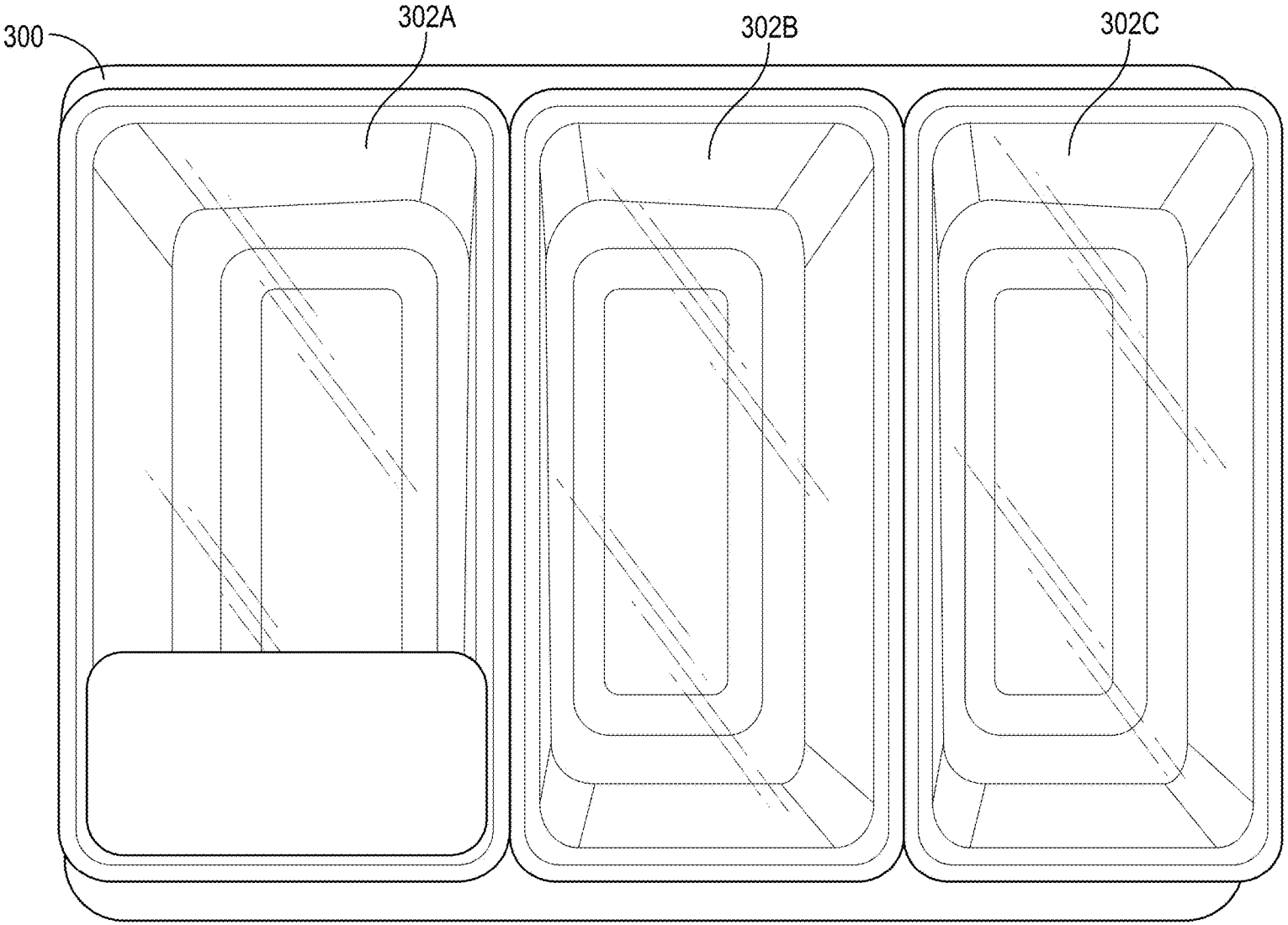
FIG. 9 is a top view of another embodiment of a packaging unit for food containers such as shown in FIG. 3.
Figure 10:
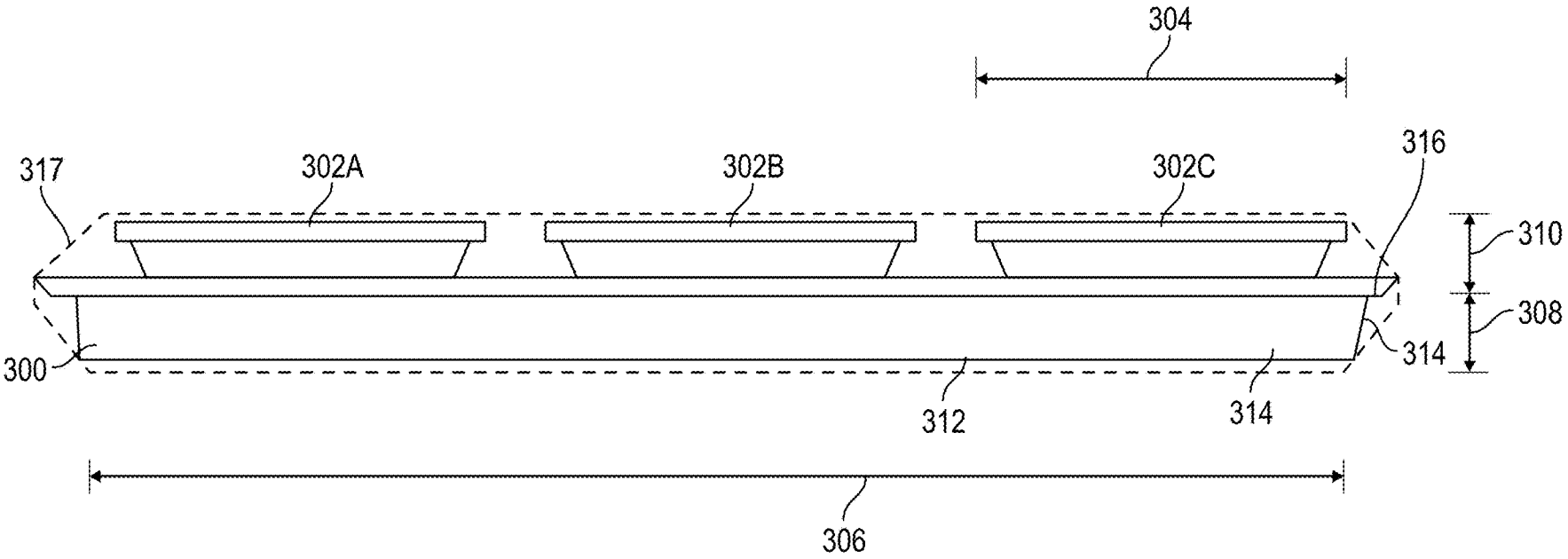
FIG. 10 is a front view of the example tray packaging of FIG. 9.

FIGS. 9 and 10 illustrates another embodiment of a packaging element employing a tray 300. Other embodiments can include other suitable types of packaging elements. Tray 300 can be made of a cardboard or recyclable paper material, such as sugarcane. Tray 300 can have four substantially vertical walls 314 and a bottom 312 together forming a cavity in which containers 302A-C are received. The dimensions of tray 300 can be configured such that tray 300 receives a certain number of containers 302 (e.g., 2, 3, 6, or another number). Containers 302 can be substantially as described above with respect to containers 202. Tray 300 has a depth 308 that is less that than the depth of containers 302. This depth difference is illustrated by distance 310 of containers above tray rim 316. Width 306 of tray 300 can be sized to receive a certain number of containers 302 based on width 304 of containers 302. By way of example in FIG. 10, width 306 can be larger than three times width 304 so that tray 300 can receive three containers 302. In some embodiments, an outer wrap 317 is placed around tray 300 and containers 302A-C. The outer wrap 317 can be a securing film, such as a shrink wrap that is placed completely around the tray 300 and containers 302A-C to hold containers 302A-C in tray 300. In other embodiments, the outer wrap 317 can be a band or cord that wraps around tray 300, but only covers a portion of the outer surface. The band or cord can also secure containers 302A-C to tray 300 to prevent them from falling out of tray 300.

Figure 11:
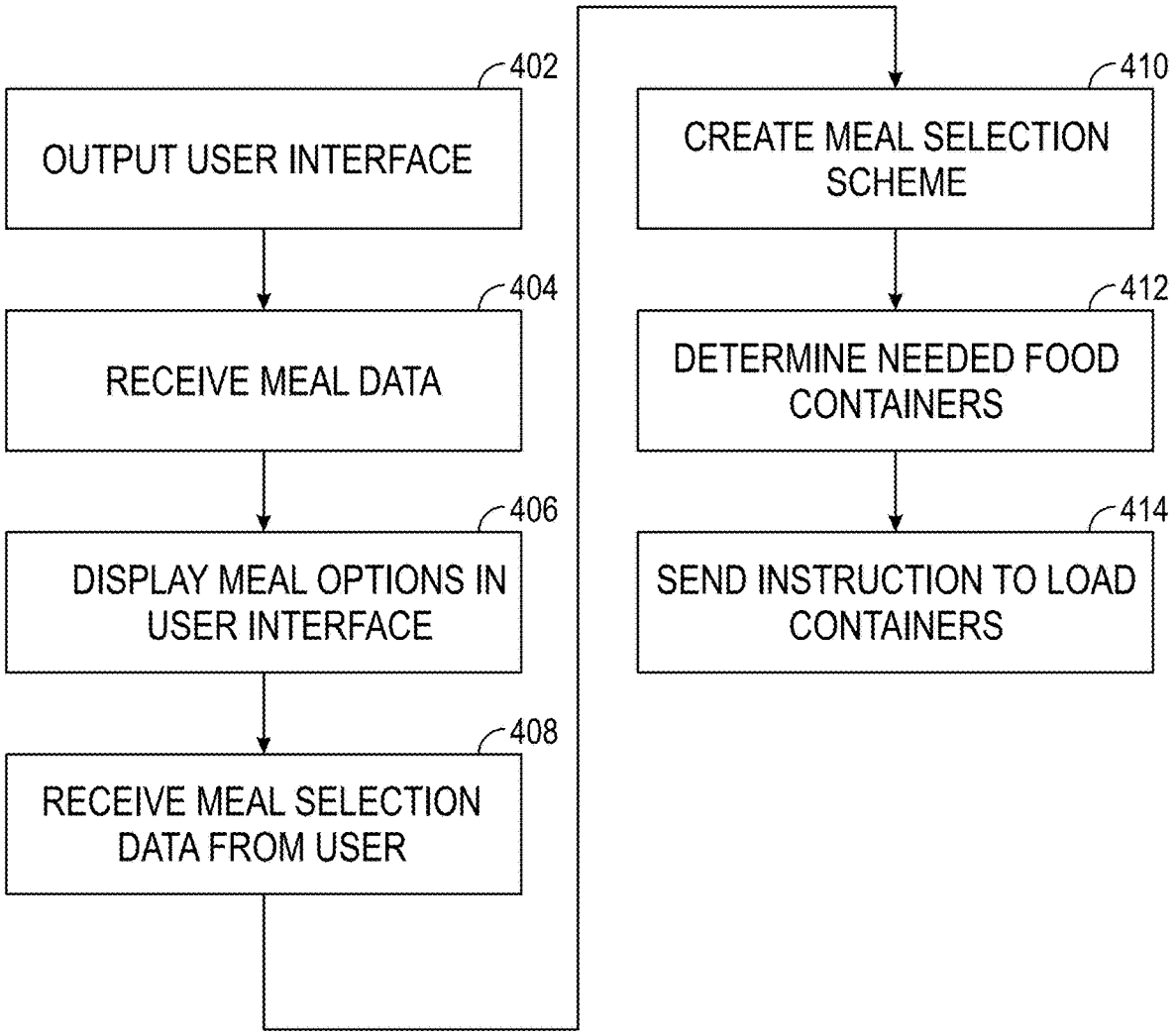
FIG. 11 is a flow chart of an example method for providing a packaged meal.
Figure 13:
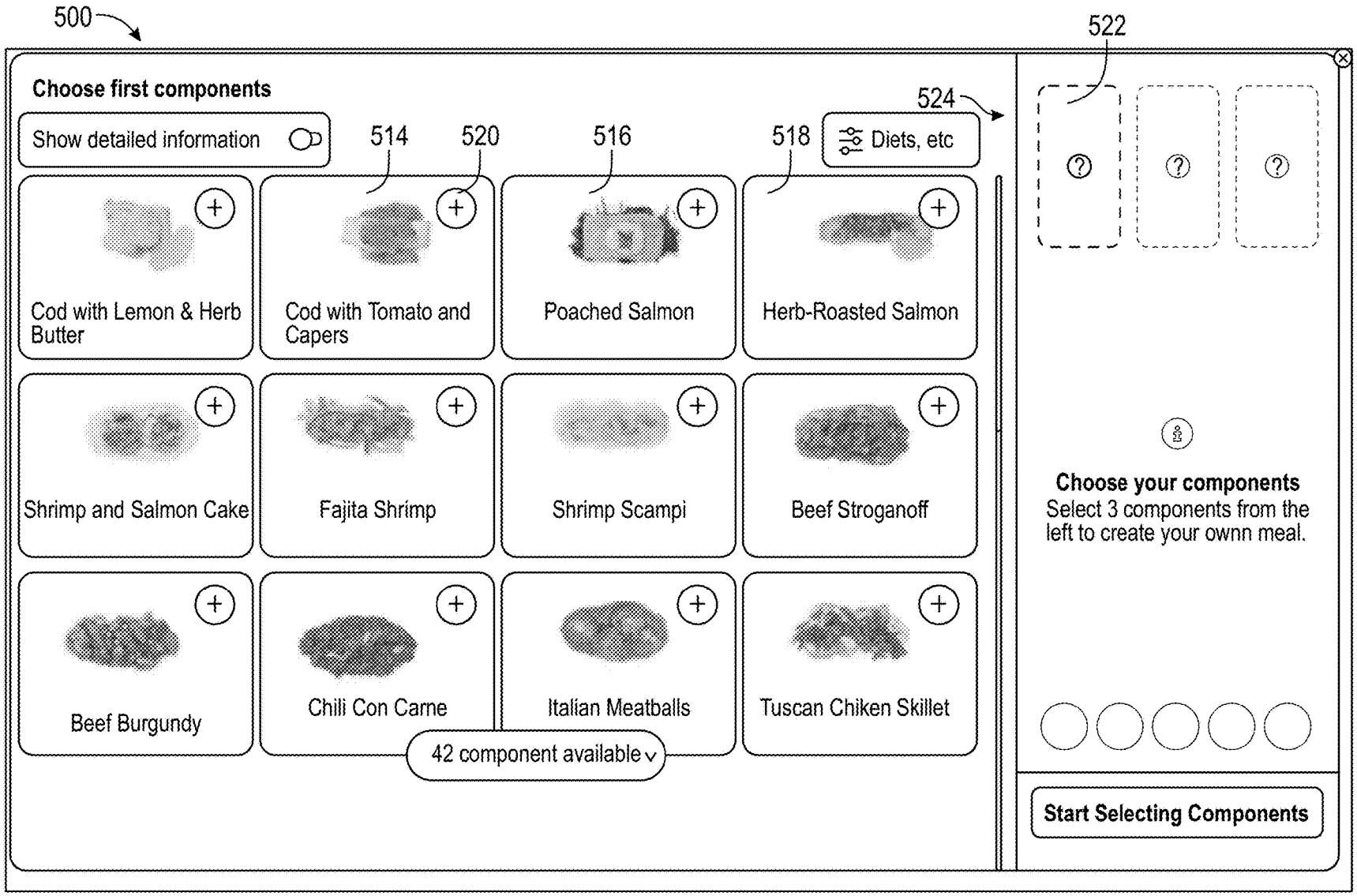
FIG. 13 illustrates an example user interface of a meal packaging system.

FIG. 11 illustrates a process by which the meal configuration engine may operate. A user interface of an electronic device displays a user interface (step 402) that provides a user with options for selecting a meal or components. The user interface may be served by a meal configuration engine, as described above in the context of FIG. 1. The meal configuration engine may include or have access to a data store 104 of data related to various food components and meals. The meal configuration engine can access the data store 104 and retrieve data (step 404) related to pre-configured meals (e.g., FIG. 12) and/or food components (FIG. 13). The meal configuration engine can then take the retrieved data and display meal options in the interface (step 406). An example of such a user interface is shown in FIG. 12, in which the user interface 500 displays a plurality of pre-configured meals 502, 504, 506 (and others) that a user may choose by clicking on a corresponding selection button 510 for each meal. Each pre-configured meal includes a combination of meal components that the system has identified based on one or more rules, such as a product availability, user preference, total calorie limitations, and the like. In some embodiments, the user interface 500 can provide a selection of multiple pre-configured meals as part of a bundle. The bundle may, for example, be based on a specific type of diet or nutritional plan or philosophy such a ketogenic diet, a Mediterranean diet, or a diabetic friendly diet. Selection indication 508 can show information related to the user's selection of a meal. The pre-configured meals displayed can also be generated based on the results of a user-answered questionnaire, such as the example provided in FIG. 20. Additionally, the meal configuration engine can populate one or more fields of the user interface with images of meals or food components.

Customization button 512 can provide the user with options to customize a pre-configured meal, for example, by exchanging one or more of the food components within the meal with another food component. When a user makes a selection in user interface 500 (e.g., by clicking selection button 510), meal selection data regarding the selection can be sent by the client device and received by the meal configuration engine (step 408). In some embodiments, one or more of the user interfaces of FIGS. 12-19 can be part of a subscription meal service. Accordingly, for example, a customization button 512 may be provided in other interfaces that permit a user to customize previously selected meals as part of a subscription service.

Figure 14:
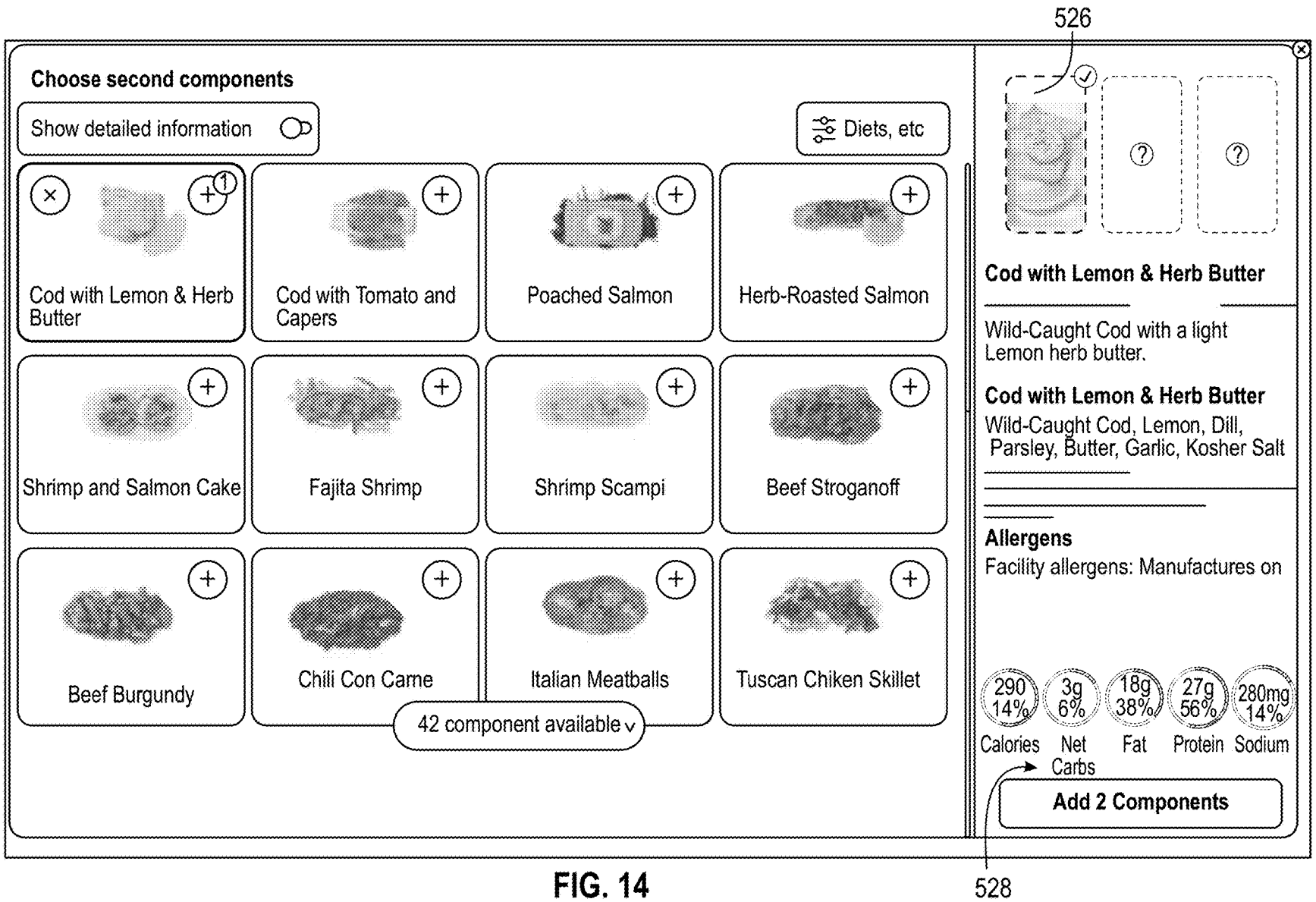
FIG. 14 illustrates an example user interface of a meal packaging system.
Figure 15:
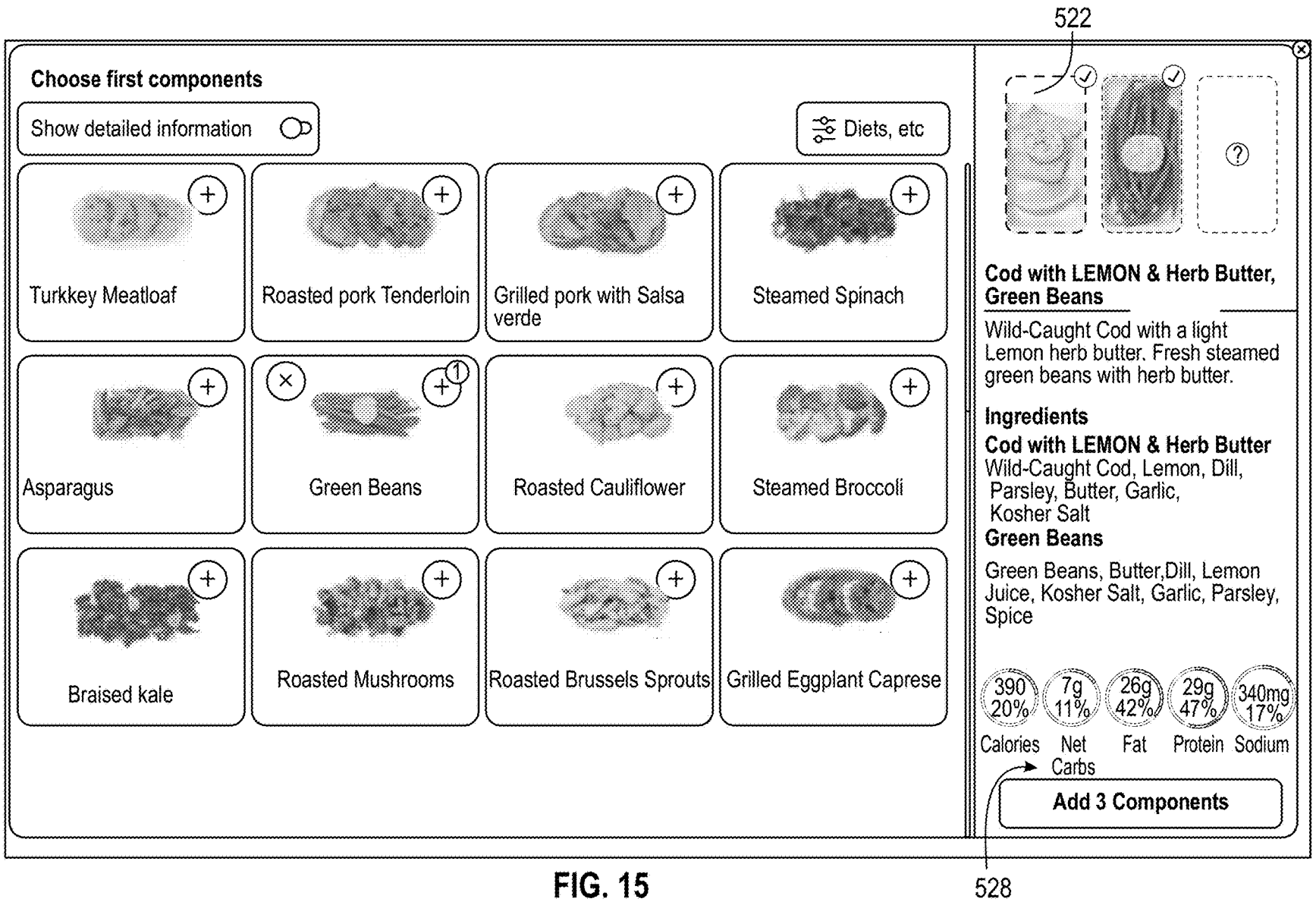
FIG. 15 illustrates an example user interface of a meal packaging system.
Figure 16:
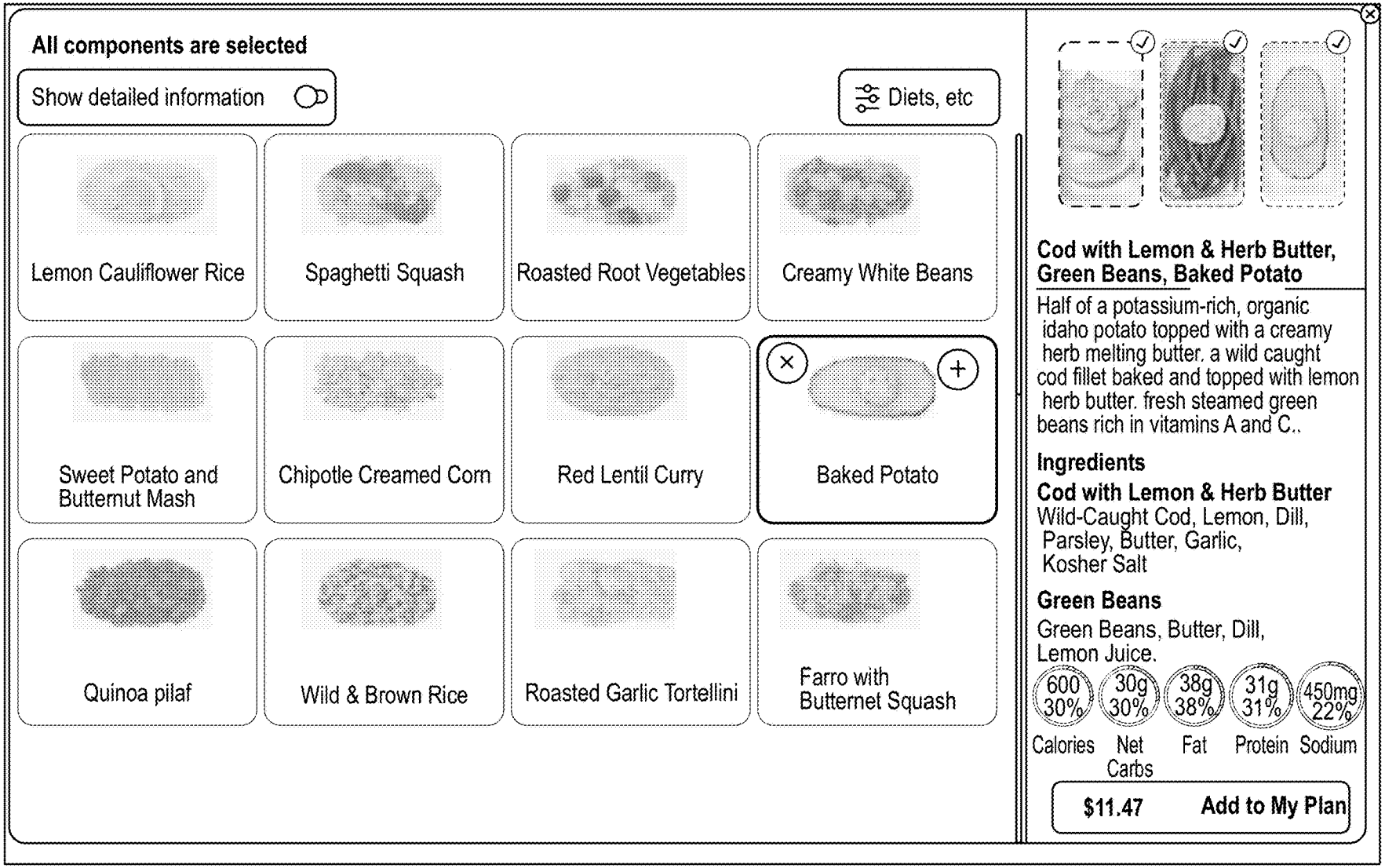
FIG. 16 illustrates an example user interface of a meal packaging system.
Figure 17:
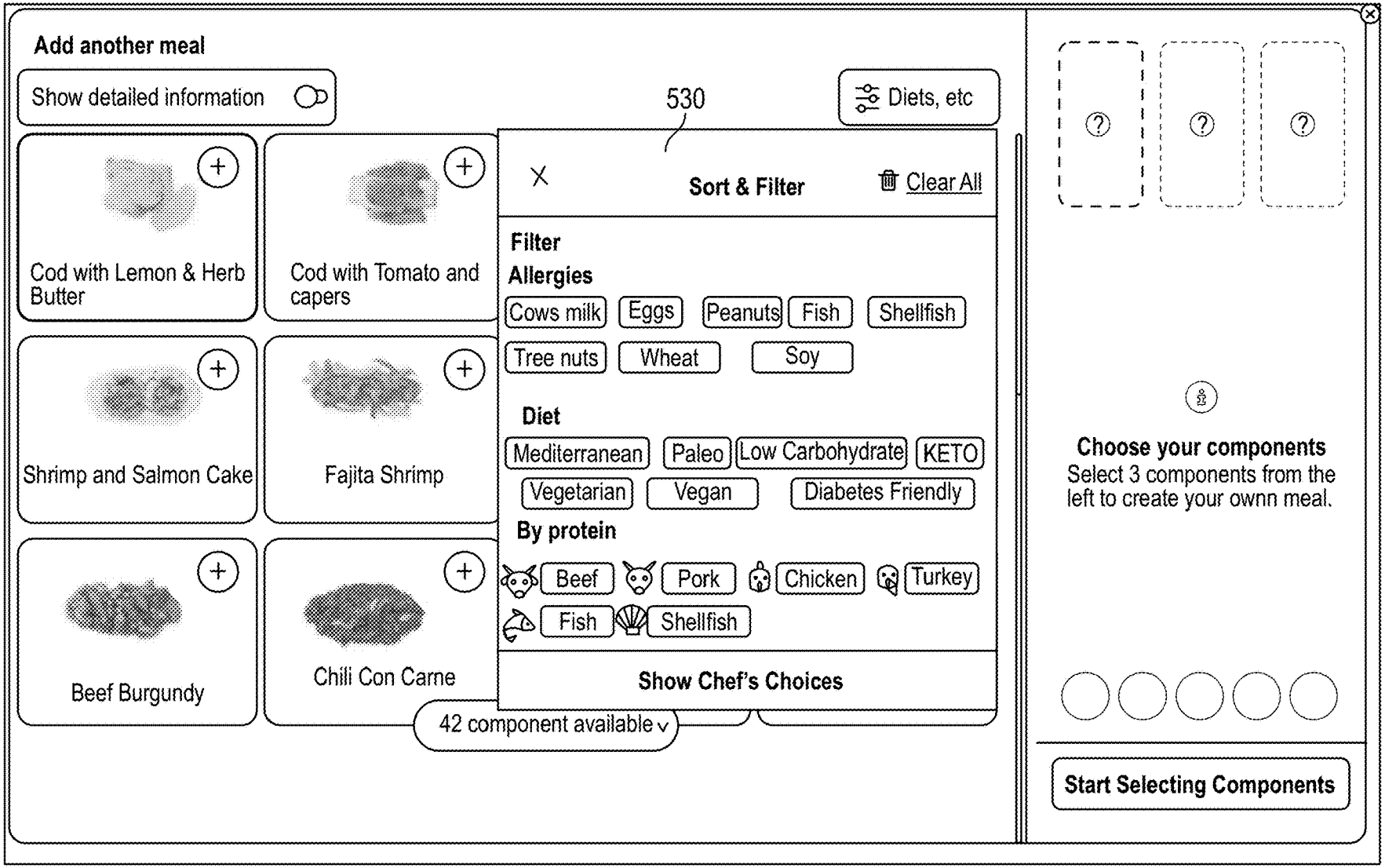
FIG. 17 illustrates an example user interface of a meal packaging system.

Another example of such a user interface is shown in FIGS. 13-17, in which individual food components can be selected by the user. The user interface 500 can provides a plurality of food component selections 514, 516, 518 (and others) that a user may choose by clicking on selection button 520. The user's selection can appear in selection indication 522 of sector 524, which can indicate to the user which food components the user has selected for the current meal. For example, as shown by FIG. 14, area 526 can indicate that the user selected Cod for the first food component. A food data field 528 can be updated when a selection is made by retrieving the data for the selected meal and its components from the data store. Food data field 528 can display nutritional facts about the particular selection, or the combination of food components making up the selected meal. FIGS. 15 and 16 similarly show the further selection and updating of interface 500 with the user's selection of Green Beans and Baked Potato as meal components for the selected meal. In some embodiments, the food data field 528 can include an image that is dynamically updated based on the user's selections. For example, when the user selects Green Beans and Baked Potato, the image may be updated to depict Green Beans and a Baked Potato. Such update can occur by retrieving photographs or other images associated with food components from storage (e.g., storage 104) and combining the retrieved images. In some embodiments, the user may select a filter menu 530 (FIG. 17) to further sort meals or food components by diet, food type, allergies, or categories.

Figure 18:
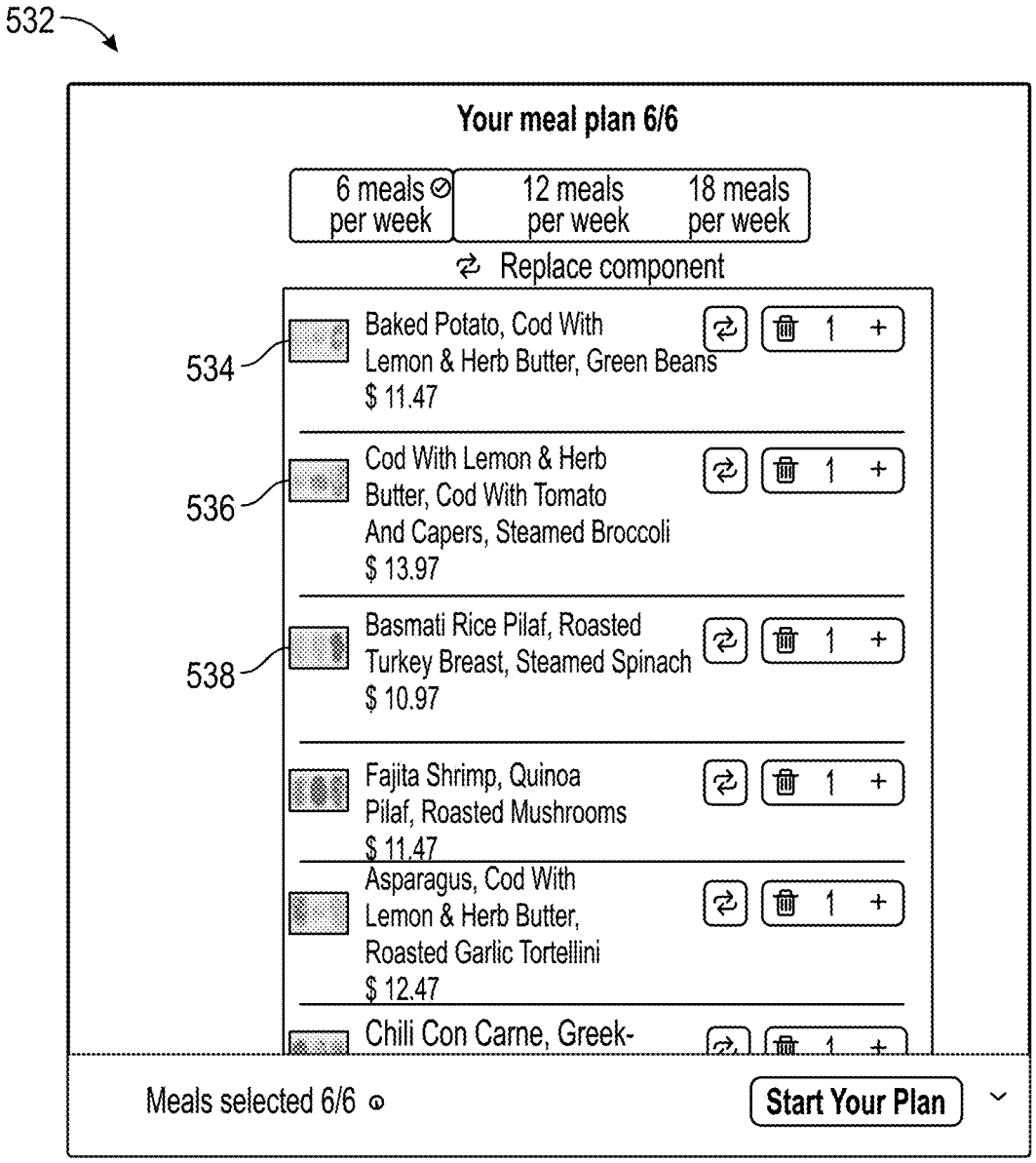
FIG. 18 illustrates an example user interface of a meal packaging system.

Referring to FIG. 18, upon making the user's food selections, the interface 500 may present a screen 532 showing a recap of the user's selections, including meals 534, 536, 538. FIG. 19 shows a customization window 540 from which a user may customize the selection of food components within in a meal.

FIG. 20 shows an alternative or additional method of retrieving meal selection data via interface 600. Interface 600 can present the user one or more questions 602, 606, 610 to which the user can answer. The user may answer the questions using responses options 604, 608, 612 that can be text boxes, button, drop-down menu selections, radio button selections, or selectable options. When the user has completed their answer, they can use submit option 614, which will cause the user device 106 to transmit the data to packaging computing device 110.

Referring back to FIG. 11, upon receiving the meal selection data from the user, packaging computing device 110 can analyze the data and use it to determine a food selection scheme (step 410) as described above. Based on the food selection scheme, the needed food containers can be determined (step 412). In some embodiments, a machine learning algorithm may be employed to analyze the user's selections or results and determine a number and type of food components to provide to the user. Packaging computing device 108 can also determine a type of packaging, number of packaging options (e.g., 3 or 6 containers in a container sleeve), a size of packaging, or other packaging related information based on the user's selections and include this information in the food selection scheme.

Once the needed food containers are determined, instructions can be sent to load the corresponding containers into a container sleeve (step 414). The instructions can be sent to a display or to a packaging device 114, as described above. Accordingly, a human packer or the packaging device 114 can retrieve the need containers and load them into a container sleeve. Additionally, in some embodiments, the instructions may include instructions to fill empty containers with certain food components. The instructions may also indicate a specific size or type of container or container sleeve, based on the meal selection scheme. For example, meals that are larger in volume or weight than other may receive larger containers. As another example, a meal with more components may receive a container sleeve with additional compartments. As another example, the meal selection data can include an indication of total meal volume and the amounts of the first, second, and third components can be based determined based on the total meal volume. As another example, a meal size can be determined based on the meal selection data and the container sleeve can be selected and obtained based on the meal size. Similarly, the food containers may be selected based on the corresponding container sleeve size. After the containers are selected and filled, the containers can be loaded into the compartments of the container sleeve in an orientation in which the open end exposes at least a portion of the first, second, and third containers; and the exposed portions of the first, second, and third trays display an identifier.

The instructions can further include instructions to generate or print a packaging label to be placed on food containers. The packaging label can include identifier 208, which, as described above, can include one or more of a name, food type, expiration date, or machine-readable identifier. After the label is generated and printed, a human packer or packaging device 114 can place the label on a corresponding food container. In some embodiments, a composite label can be generated and printed. The composite label can indicate the components of a meal placed within a single container sleeve 200. The composite label can include composite nutritional information that indicates combined nutritional information for the food components comprising the meal (e.g., total calories, total macronutrients, total micronutrients, etc. for the entire meal). The composite label can then be placed on a corresponding container sleeve.

The system's data store also may contain inventory information identifying meals and/or meal components that have been shipped to each user but not yet used by the user. The packer (prior to shipment of each meal component container sleeve) or an end consumer (upon receipt or upon using a meal component in a sleeve) can scan the identifier of that sleeve (e.g., with a barcode scanner, smartphone, or other capable electronic device). In response on the scanning, an inventory of food components that is associated with an individual can be updated. For example, on the shipping side, an inventory of shipped food components for a particular user can be updated by scanning the sleeves of each meal components prior to shipment to the user. On the end user side, the user can scan the components with the client device 106 upon receipt and/or upon use and have an inventory of the components in their possession updated. This inventory may be stored locally or sent to server 102. If sent to server 102, the meal configuration engine can provide updated meal suggestions to the user based on the components the user currently has in possession. For example, the meal configuration engine can analyze the available food components and create new meal combinations based on the available components. These suggestions can provide the end user with some variety in their meals that they may not otherwise enjoy.

Other advantages of the present invention can be apparent to those skilled in the art from the foregoing specification. Accordingly, it will be recognized by those skilled in the art that changes or modifications may be made to the above-described embodiments without departing from the broad inventive concepts of the invention. It should therefore be understood that this invention is not limited to the particular embodiments described in this document, but is intended to include all changes and modifications that are within the scope and spirit of the invention as defined in the claims.

As used in this document, the singular forms "a," "an," and "the" include plural references unless the context clearly dictates otherwise. Unless defined otherwise, all technical and scientific terms used herein have the same meanings as commonly understood by one of ordinary skill in the art. As used in this document, the term "comprising" (or "comprises") means "including (or includes), but not limited to." When used in this document, the term "exemplary" is intended to mean "by way of example" and is not intended to indicate that a particular exemplary item is preferred or required.

In this document, when terms such "first" and "second" are used to modify a noun, such use is simply intended to distinguish one item from another, and is not intended to require a sequential order unless specifically stated. The term "approximately," when used in connection with a numeric value, is intended to include values that are close to, but not exactly, the number. For example, in some embodiments, the term "approximately" may include values that are within +/−10 percent of the value.

In this document, the term "connected", when referring to two physical structures, means that the two physical structures touch each other. Devices that are connected may be secured to each other, or they may simply touch each other and not be secured.

When used in this document, terms such as "top" and "bottom," "upper" and "lower", or "front" and "rear," are not intended to have absolute orientations but are instead intended to describe relative positions of various components with respect to each other. For example, a first component may be an "upper" component and a second component may be a "lower" component when a device of which the components are a part is oriented in a first direction. The relative orientations of the components may be reversed, or the components may be on the same plane, if the orientation of the structure that contains the components is changed. The claims are intended to include all orientations of a device containing such components.

This disclosure is not limited to the particular systems, methodologies or protocols described, as these may vary. The terminology used in this description is for the purpose of describing the particular versions or embodiments only, and is not intended to limit the scope.

Without excluding further possible embodiments, certain example embodiments are summarized in the following clauses:

Clause 1: A meal packaging system, comprising:

a divided packaging that includes:

an outer shell defining an interior, and at least one divider disposed within the outer shell, which divider divides the interior into a plural number of container compartments having compartment dimensions;

a plurality of food containers, each of which is configured and dimensioned to fit within at least one of the container compartments; and a computing device having a processor configured to execute instructions to cause the computing device to:

receive food selection data;

generate a food selection scheme based on the food selection data; and output the food selection scheme;

wherein the food selection scheme comprises instructions to place first and second of the food containers within first and second of the compartments.

Clause 2: The meal packaging system of clause 1, further comprising a user electronic device configured to receive food selections from a user and transmit the food selection data to the computing device Clause 3: The meal packaging system of any of the preceding clauses, wherein outputting the food selection scheme comprises displaying an indication of the first and second food containers.

Clause 4: The meal packaging system of any of the preceding clauses, wherein outputting the food selection scheme comprises displaying an indication of options or meal combinations based on the food selection data.

Clause 5: The meal packaging system of any of the preceding clauses, wherein at least one of the plurality of food containers are dimensioned to have an interference fit with the divided packaging.

Clause 6: The meal packaging system of any of the preceding clauses, wherein the divided packaging comprises a sleeve comprising four sides defining an interior.

Clause 7: The meal packaging system of any of the preceding clauses, wherein the compartments are vertically stacked.

Clause 8: The meal packaging system of any of the preceding clauses, wherein the food selection scheme includes an indication of a specific number of food containers based on a number of compartments of the divided packaging.

Clause 9: The meal packaging system of any of the preceding clauses, wherein outputting the food selection scheme comprises sending instructions to a packaging device.

Clause 10: The meal packaging system of clause 9, wherein the packaging device comprises a container filler configured to fill the first and second food containers with corresponding food components.

Clause 11: The meal packaging system of clause 9, wherein the packaging device comprises a plurality of pre-filled food containers and is configured to load the pre-filled food containers into the divided packaging.

Clause 12: The meal packaging system of any of the preceding clauses, wherein the first container contains a first food component and the second food container contains a second food component.

Clause 13: The meal packaging system of clause 12, wherein the first food component is different from the second food component.

Clause 14: The meal packaging system of clause 13, wherein the first and second food components together comprise a meal.

Clause 15: The meal packaging system of clause 14, wherein the meal is based on a volume of food.

Clause 16: The meal packaging system of clause 14, wherein the meal is based on a mass of food.

Clause 17: The meal packaging system of clause 14, wherein the meal is based on a food type of the first food component and the second food component.

Clause 18: The meal packaging system of clause 14, wherein the meal is based on a cumulative nutritional value of the first and second food components.

Clause 19: A vertical meal container, comprising:

a container sleeve defined by four sides, a first end, and a second end;

a first shelf disposed on the interior of the sleeve and attached to a first side and a second side of the four sides;

a second shelf disposed on the interior of the sleeve parallel to the first shelf and attached to the first and second sides; and a plurality of food containers comprising four upright walls, a bottom, and an openable top;

wherein a first food container is disposed between the first shelf and a third side of the sleeve;

wherein a second food container is disposed between the first and second shelves; and wherein a third food container is disposed between the second shelf and a fourth side of the sleeve.

Clause 20: The meal container of clause 19, further comprising a handle located on the fourth side of the sleeve.

Clause 21: The meal container of clause 20, wherein the handle comprises one or more openings in the fourth side.

Clause 22: The meal container of any of any of clauses 19-21, wherein the first shelf and the second shelf extend longitudinally from the first end to the second end.

Clause 23: The meal container of any of any of clauses 19-22, wherein:

the first end of the container sleeve comprises an opening;

the first and second food containers include an identifier; and the identifier is readable through the opening.

Clause 24: The meal container of clause 23, wherein the opening is a translucent portion of the first end.

Clause 25: The meal container of clause 23, wherein the opening is a window through a portion of the first end.

Clause 26: The meal container of clause 23, wherein the opening defines an access port for adding or removing food containers from the container sleeve.

Clause 27: The meal container of any of clauses 23-26, wherein:

the container sleeve further comprises a door;

the door covers the opening when the door is in a closed position; and the compartments are accessible when the door is in an open position.

Clause 28: The meal container of clause 27, wherein the identifier is not readable when the door is in the closed position.

Clause 29: The meal container of clause 27, wherein the identifier is readable when the door is in the closed position.

Clause 30: The meal container of any of clauses 23-29, wherein the identifier is machine-readable and comprises one or more of the following: a bar code, a QR code, an electronic tag, or an RFID tag.

Clause 31: The meal container of any of clauses 23-30, wherein the identifier comprises an expiration date.

Clause 32: The meal container of any of clauses 23-31, wherein the identifier comprises a food type.

Clause 33: The meal container of any of clauses 19-32 wherein:

the container sleeve further comprises a handle disposed on a first of the sides; and the container sleeve further comprises an opening on a second side that is perpendicular to the first side.

Clause 34: The meal container of clause 33, wherein the handle is configured to be grasped from the top of the container sleeve.

Clause 35: The meal container of any of clauses 33-34, wherein the handle comprises one or more openings.

Clause 36: The meal container of clause 35, wherein the wherein the openings are cutouts in the first side.

Clause 37: The meal container of any of clauses 19-36, wherein the food containers are sized relative to the container sleeve such that the container sleeve applies pressure to two opposite sides of the container sleeve.

Clause 38, The meal container of any of clauses 19-37, wherein:

the first end of the container sleeve is open; and the second end of the container sleeve is closed.

Clause 39: A method for providing packaged meals, comprising: receiving, by a processor, meal selection data;

determining, by the processor and based on the meal selection data, a meal comprising a first food component, a second food component, and a third food component;

filling a first container with an amount of the first component;

filling a second container with an amount of the second component;

filling a third container with an amount of the third component;

obtaining a container sleeve comprising an outer wrap, an open end, and three compartments defined by a first shelf and a second shelf; and loading the first, second, and third containers into the compartments of the container sleeve.

Clause 40: The method of clause 39, wherein the meal selection data comprises an indication of total meal calories, and the amounts of the first, second, and third components are based on the total meal calories.

Clause 41: The method of any of clauses 39-40, wherein the meal selection data comprises an indication of total meal mass, and the amounts of the first, second, and third components are based on the total meal mass.

Clause 42: The method of any of clauses 39-41, wherein the meal selection data comprises an indication of a cumulative nutritional value, and the amounts of the first, second, and third components are based on the cumulative nutritional value.

Clause 43: The method of any of clauses 39-42, wherein the meal selection data comprises an indication of total meal volume and the amounts of the first, second, and third components are based on the total meal volume.

Clause 44: The method of any of clauses 39-43, further comprising determining a meal size based on the meal selection data;

wherein obtaining the container sleeve is based on the meal size; and wherein the first, second, and third containers have a size corresponding to the container sleeve size.

Clause 45: The method of any of clauses 39-44, further comprising sealing the filled first, second, and third containers.

Clause 46: The method of any of clauses 39-45, wherein:

the first, second, and third containers are loaded into the compartments of the container sleeve in an orientation in which the open end exposes at least a portion of the first, second, and third containers; and the exposed portions of the first, second, and third containers display an identifier.

Clause 47: The method of clause 46, further comprising:

scanning the identifier; and updating, based on the scanning, an inventory of food components that is associated with an individual.

What is claimed is:

1. A meal packaging system, comprising:

a divided packaging that includes:

an outer shell defining an interior, and at least one divider disposed within the outer shell, which divider divides the interior into a plural number of container compartments including a first and second container compartments having compartment dimensions;

a plurality of food containers including a first and second food container each containing a food component, each of first and second food containers is configured and dimensioned to fit within at least one of the first and second container compartments, at least one of the first and second food containers comprising a machine-readable identifier indicating the food component contained within the at least one of the first and second food containers, the machine-readable identifier configured to, when scanned by a user device, cause a computing device to update an inventory of food components associated with a user; and wherein the computing device has a processor configured to execute instructions to cause the computing device to:

receive meal selection data;

generate a food selection scheme based on the meal selection data; and output the food selection scheme;

wherein the food selection scheme comprises instructions to place the first and second food containers within the first and second container compartments, and place the machine-readable identifier on the at least one of the first and second food containers; and wherein the computing device is further configured to:

receive, from the user device on scanning the machine-readable identifier, a request to update the inventory of food components associated with the user; and in response to receiving the request, create a new meal combination of food components associated with the user based on the updated inventory.

2. The meal packaging system of claim 1, wherein the user device further comprises a user electronic device configured to receive meal selections from the user and transmit the meal selection data to the computing device.

3. The meal packaging system of claim 1, wherein outputting the food selection scheme comprises displaying an indication of the first and second food containers.

4. The meal packaging system of claim 1, wherein outputting the food selection scheme comprises displaying an indication of options or meal combinations based on the meal selection data.

5. The meal packaging system of claim 1, wherein at least one of the first and second food containers is dimensioned to have an interference fit with at least one of the first and second container compartments of the divided packaging.

6. The meal packaging system of claim 1, wherein the divided packaging comprises a sleeve comprising four sides defining an interior.

7. The meal packaging system of claim 1, wherein the compartments are vertically stacked.

8. The meal packaging system of claim 1, wherein the food selection scheme includes an indication of a specific number of food containers based on a number of compartments of the divided packaging.

9. The meal packaging system of claim 1, wherein outputting the food selection scheme comprises sending instructions to a packaging device.

10. The meal packaging system of claim 9, wherein the packaging device comprises a container filler configured to fill the first and second food containers with corresponding food components.

11. The meal packaging system of claim 9, where in the packaging device comprises a plurality of pre-filled first and second food containers and is configured to load the pre-filled first and second food containers into the divided packaging.

12. The meal packaging system of claim 1, wherein the first container contains a first food component and the second food container contains a second food component.

13. The meal packaging system of claim 12, wherein the first food component is different from the second food component.

14. The meal packaging system of claim 13, wherein the first and second food components together comprise a meal.

15. The meal packaging system of claim 14, wherein the meal is based on a volume of food.

16. The meal packaging system of claim 14, wherein the meal is based on a mass of food.

17. The meal packaging system of claim 14, wherein the meal is based on a food type of the first food component and the second food component.

18. The meal packaging system of claim 14, wherein the meal is based on a cumulative nutritional value of the first and second food components.

19. The meal packaging system of claim 1, wherein the machine-readable identifier comprising an RFID tag.

* * * * *